US006705385B2

(12) United States Patent
Ray et al.

(10) Patent No.: US 6,705,385 B2
(45) Date of Patent: Mar. 16, 2004

(54) CASTINGS OF METALLIC ALLOYS WITH IMPROVED SURFACE QUALITY, STRUCTURAL INTEGRITY AND MECHANICAL PROPERTIES FABRICATED IN ANISOTROPIC PYROLYTIC GRAPHITE MOLDS UNDER VACUUM

(75) Inventors: Ranjan Ray, Phoenix, AZ (US); Donald W. Scott, Peoria, AZ (US)

(73) Assignee: Santoku America, Inc., Tolleson, AZ (US)

( * ) Notice: Subject to any disclaimer, the term of this patent is extended or adjusted under 35 U.S.C. 154(b) by 0 days.

(21) Appl. No.: 10/151,871

(22) Filed: May 22, 2002

(65) Prior Publication Data

US 2003/0042001 A1 Mar. 6, 2003

Related U.S. Application Data

(60) Provisional application No. 60/292,536, filed on May 23, 2001.

(51) Int. Cl.[7] ..... B22C 9/00; B22D 11/00; B22D 27/04; B05D 3/02

(52) U.S. Cl. ..... 164/529; 164/418; 164/459; 164/4.1; 164/121; 164/122; 427/228; 148/555

(58) Field of Search ..... 164/529, 418, 164/459, 4.1, 121, 122; 427/228; 148/555

(56) References Cited

U.S. PATENT DOCUMENTS

| | | | | |
|---|---|---|---|---|
| 2,977,222 | A | 3/1961 | Bieber | 172/823 |
| 3,241,200 | A | 3/1966 | Lirones | 164/517 |
| 3,243,733 | A | 3/1966 | Hosman | 333/106 |
| 3,257,692 | A | 6/1966 | Operhall | 164/517 |
| 3,265,574 | A | 8/1966 | Scolari | 600/4 |
| 3,266,106 | A | 8/1966 | Lirones | 164/517 |
| 3,296,666 | A | 1/1967 | Lirones | 164/517 |
| 3,321,005 | A | 5/1967 | Lirones | 164/518 |
| 3,389,743 | A | 6/1968 | Morozov et al. | 164/516 |
| 3,485,288 | A | 12/1969 | Zusman et al. | 164/34 |
| 3,492,197 | A | 1/1970 | Olstowski et al. | 428/412 |
| 3,519,503 | A | 7/1970 | Moore et al. | 148/514 |
| 3,547,676 | A | 12/1970 | Bokros et al. | 427/213 |
| 3,567,896 | A | 3/1971 | Chang | 219/50 |
| 3,683,996 | A | 8/1972 | Dunlop | 164/14 |
| 3,718,720 | A | 2/1973 | Lambdin, Jr. et al. | 264/29 |
| 3,781,158 | A | 12/1973 | Leghorn | 164/459 |
| 3,900,540 | A | 8/1975 | Robba et al. | 264/29.6 |

(List continued on next page.)

FOREIGN PATENT DOCUMENTS

| | | |
|---|---|---|
| JP | 55149747 | 11/1980 |
| JP | 60040644 | 3/1985 |
| SU | 1306641 | 4/1987 |

OTHER PUBLICATIONS

USSN 10/163,345, Ranjan Ray et al., filed Jun. 7, 2002.
USSN 10/143,920, Ranjan Ray et al., filed May 14, 2002.

*Primary Examiner*—M. Alexandra Elve
*Assistant Examiner*—I.-H. Lin
(74) *Attorney, Agent, or Firm*—Stevens, Davis, Miller & Mosher, LLP

(57) ABSTRACT

Molds are fabricated having a substrate of high density, high strength ultrafine grained isotropic graphite, and having a mold cavity coated with pyrolytic graphite. The molds may be made by making the substrate (main body) of high density, high strength ultrafine grained isotropic graphite, by, for example, isostatic or vibrational molding, machining the substrate to form the mold cavity, and coating the mold cavity with pyrolytic graphite via a chemical deposition process. The molds may be used to make various metallic alloys such as nickel, cobalt and iron based superalloys, stainless steel alloys, titanium alloys and titanium aluminide alloys into engineering components by melting the alloys in a vacuum or under a low partial pressure of inert gas and subsequently casting the melt in the graphite molds under vacuum or low partial pressure of inert gas.

39 Claims, 15 Drawing Sheets

U.S. PATENT DOCUMENTS

| | | | | |
|---|---|---|---|---|
| 4,005,163 | A | 1/1977 | Bokros | 264/81 |
| 4,129,462 | A | 12/1978 | Korenko | 148/31 |
| 4,209,348 | A | 6/1980 | Duhl et al. | 148/555 |
| 4,226,900 | A | 10/1980 | Carlson et al. | 427/228 |
| 4,453,985 | A | 6/1984 | Gessinger et al. | 148/501 |
| 4,574,015 | A | 3/1986 | Genereux et al. | 148/677 |
| 4,579,602 | A | 4/1986 | Paulonis et al. | 148/677 |
| 4,608,192 | A | 8/1986 | Su | 252/506 |
| 4,612,062 | A | 9/1986 | Nazmy et al. | 148/501 |
| 4,627,945 | A | 12/1986 | Winkelbauer et al. | 264/29.5 |
| 4,670,201 | A | 6/1987 | Montgomery et al. | 264/26 |
| 4,719,080 | A | 1/1988 | Duhl et al. | 420/443 |
| 4,761,272 | A | 8/1988 | Hucke | 423/445 |
| 4,769,087 | A | 9/1988 | Genereux et al. | 148/677 |
| 5,026,521 | A | 6/1991 | Kajimura et al. | 420/422 |
| 5,163,498 | A | 11/1992 | Kantner et al. | 164/97 |
| 5,176,762 | A | 1/1993 | Berczik | 148/407 |
| 5,226,946 | A | 7/1993 | Diehm et al. | 75/10.14 |
| 5,489,411 | A | 2/1996 | Jha et al. | 419/3 |
| 5,525,276 | A | 6/1996 | Okuyama et al. | 264/29.3 |
| 5,630,465 | A | 5/1997 | Feagin | 164/361 |
| 5,665,262 | A | 9/1997 | Hajaligol et al. | 219/553 |
| 5,705,139 | A | 1/1998 | Stiller et al. | 423/445 R |
| 5,924,470 | A | 7/1999 | Costilla-Vela et al. | 164/4.1 |
| 5,964,091 | A | 10/1999 | Fukui et al. | 60/752 |

CASTINGS OF METALLIC ALLOYS WITH IMPROVED SURFACE QUALITY, STRUCTURAL INTEGRITY AND MECHANICAL PROPERTIES FABRICATED IN ANISOTROPIC PYROLYTIC GRAPHITE MOLDS UNDER VACUUM

CROSS-REFERENCE TO RELATED APPLICATIONS

This claims priority from U.S. provisional patent application Ser. No. 60/292,536 filed May 23, 2001 now abandoned incorporated herein by reference its entirety.

I. FIELD OF THE INVENTION

The invention relates to methods for making various metallic alloys such as nickel, cobalt and iron based superalloys, stainless steel alloys, nickel aluminides, titanium and titanium aluminide alloys, zirconium base alloys into engineering components by melting of the alloys in a vacuum or under a low partial pressure of inert gas and subsequent casting of the melt under vacuum or under a low pressure of inert gas in molds machined from fine grained high density, high strength isotropic graphite wherein the mold cavity is uniformly coated with pyrolytic graphite.

II. BACKGROUND OF THE INVENTION

A. Investment Casting

If a small casting, from ½ oz to 20 lb (14 g to 9.1 kg (mass)) or today even over 100 lb (45 kg), with fine detail and accurate dimensions is needed, lost wax investment casting is considered. This process is used to make jet engine components, fuel pump parts, levers, nozzles, valves, cams, medical equipment, and many other machine and device parts. The investment casting is especially valuable for casting difficult-to-machine metals such as superalloys, stainless steel, high-nickel alloys and titanium alloys.

The process is slow and is one of the most expensive casting processes. If a design is changed, it may require expensive alterations to a metal die (as it would in die casting also).

Preparation of investment casting molds requires operation of several equipment involving many manual processing steps such as the following.

(a) Fabrication of wax patterns via injection molding equipment, (b) manual assembly of wax patterns, (c) dipping wax patterns in six to nine different alumina or zirconia ceramic slurries contained in large vats, (d) dewaxing the molds in autoclave, and (e) preheating the molds to 2000° F. in a furnace prior to vacuum casting.

Wax injection pattern dies are expensive depending on the intricacy of the part. Lead time of six to twelve months for the wax injection die is common in the industry. Defects often occur in wax patterns due to human errors during fabrication. These defects are frequently repaired manually, which is a time consuming process.

Ceramic molds are cracked frequently during dewaxing, that leaves a positive impression on the castings, which requires manual repair.

Ceramic facecoat applied after the first dip of the wax patterns in the ceramic slurry tends to spall or crack which often get trapped as undesirable inclusions in the final castings. Ceramic facecoat would react with rare earth elements in the superalloy, such as yttrium, cerium, hafnium, etc., which may cause a deviation of the final chemistry of the castings from the required specifications.

Investment castings are removed from the mold by breaking the molds and sometime by leaching the molds in hot caustic bath followed by grit blasting. These steps additionally increase the cost of production.

B. Ceramic-Mold Processes

If long-wearing, accurate castings of tool steel, cobalt alloys, titanium, or stainless steel are desired, ceramic molds are often used instead of sand molds.

The processes use conventional patterns of ceramic, wood, plastic, or metal such as steel; aluminum and copper set in cope and drag flasks. Instead of sand, a refractory slurry is used. This is made of a carefully controlled mixture of ceramic powder with a liquid catalyst binder (an alkyl silicate). Various blends are used for specific metal castings. Ceramic molds are used only one time and are expensive.

There is a need for improving the molding of various metallic alloys such as nickel, cobalt and iron based superalloys, nickel aluminides, stainless steel alloys, titanium alloys, titanium aluminide alloys, zirconium and zirconium base alloys. Metallic superalloys of highly alloyed nickel, cobalt, and iron based superalloys are difficult to fabricate by forging or machining. Moreover, conventional investment molds and ceramic molds are used only one time for fabrication of castings of metallic alloys such as nickel, cobalt and iron based superalloys, stainless steel alloys, titanium alloys and titanium aluminide alloys. This increases the cost of production.

The term superalloy is used in this specification in its conventional sense and describes the class of alloys developed for use in high temperature environments and typically having a yield strength in excess of 100 ksi at 1000° F. Nickel base superalloys are widely used in gas turbine engines and have evolved greatly over the last 50 years. As used herein the term superalloy will mean a nickel base superalloy containing a substantial amount of the γ' (gamma prime) ($Ni_3Al$) strengthening phase, preferably from about 30 to about 50 volume percent of the gamma prime phase. Representative of such class of alloys include the nickel base superalloys, many of which contain aluminum in an amount of at least about 5 weight % as well as one or more of other alloying elements, such as titanium, chromium, tungsten, tantalum, etc. and which are strengthened by solution heat treatment. Such nickel base superalloys are described in U.S. Pat. No. 4,209,348 to Duhl et al. and U.S. Pat. No. 4,719,080 incorporated herein by reference in their entirety. Other nickel base superalloys are known to those skilled in the art and are described in the book entitled "Superalloys II" Sims et al., published by John Wiley & Sons, 1987, incorporated herein by reference in its entirety.

Other references incorporated herein by reference in their entirety and related to superalloys and their processing are cited below:

"Investment-cast superalloys challenge wrought materials" from Advanced Materials and Process, No. 4, pp. 107–108 (1990).

"Solidification Processing", editors B. J. Clark and M. Gardner, pp. 154–157 and 172–174, McGraw-Hill (1974).

"Phase Transformations in Metals and Alloys", D. A. Porter, p. 234, Van Nostrand Reinhold (1981).

Nazmy et al., The effect of advanced fine grain casting technology on the static and cyclic properties of IN713LC, Conf: High temperature materials for power engineering 1990, pp. 1397–1404, Kluwer Academic Publishers (1990).

Bouse & Behrendt, Mechanical properties of Microcast-X alloy 718 fine grain investment castings, Conf: Superalloy 718: Metallurgy and applications, Publ:TMS pp. 319–328 (1989).

Abstract of U.S.S.R. Inventor's Certificate 1306641, published Apr. 30, 1987.

WPI Accession No. 85-090592/85 & Abstract of JP 60-0644 (KAWASAKI), published Mar. 4, 1985.

WPI Accession No. 81-06485D/81 & Abstract of JP 55-149747 (SOGO), published Nov. 21, 1980.

Fang, J; Yu, B, Conference: High Temperature Alloys for Gas Turbines, 1982, Liege, Belgium, Oct. 4–6, 1982, pp. 987–997, Publ: D. Reidel Publishing Co., P.O. Box 17, 3300 AA Dordrecht, The Netherlands (1982).

Processing techniques for superalloys have also evolved as evident from the following references incorporated herein by reference in their entirety. Many of the newer processes are quite costly.

U.S. Pat. No. 3,519,503 describes an isothermal forging process for producing complex superalloy shapes. This process is currently widely used, and as currently practiced requires that the starting material be produced by powder metallurgy techniques. The reliance on powder metallurgy techniques makes this process expensive.

U.S. Pat. No. 4,574,015 deals with a method for improving the forgeability of superalloys by producing overaged microstructures in such alloys. The gamma prime phase particle size is greatly increased over that which would normally be observed.

U.S. Pat. No. 4,579,602 deals with a superalloy forging sequence that involves an overage heat treatment.

U.S. Pat. No. 4,769,087 describes another forging sequence for superalloys.

U.S. Pat. No. 4,612,062 describes a forging sequence for producing a fine grained article from a nickel base superalloy.

U.S. Pat. No. 4,453,985 describes an isothermal forging process that produces a fine grain product.

U.S. Pat. No. 2,977,222 describes a class of superalloys.

Since, the introduction of titanium and titanium alloys in the early 1950's, these materials have found widespread uses in aerospace, energy, and chemical industries. The combination of high strength-to-weight ratio, excellent mechanical properties, and corrosion resistance makes titanium the best material for many critical applications. Titanium alloys are used for static and rotating gas turbine engine components. Some of the most critical and highly stressed civilian and military airframe parts are made of these alloys.

The use of titanium has expanded in recent years from applications in food processing plants, from oil refinery heat exchangers to marine components and medical prostheses. However, the high cost of titanium alloy components may limit their use. The relatively high cost is often fabricating costs, and, usually most importantly, the metal removal costs incurred in obtaining the desired end-shape. As a result, in recent years a substantial effort has been focused on the development of net shape or near-net shape technologies such as powder metallurgy (PM), superplastic forming (SPF), precision forging, and precision casting. Precision casting is by far the most fully developed and the most widely used net shape technology. Titanium castings present certain advantages. The microstructure of as-cast titanium is desirable for many mechanical properties.

The properties of titanium castings are generally comparable to wrought products in all respects and quite often superior. Properties associated with fatigue crack propagation and creep resistance can be superior to those of wrought products. As a result, titanium castings can be cost competitive with the forged and machined parts in many demanding applications. Titanium undergoes (alpha+beta) to beta allotropic phase transformation at a temperature range of 705° C. to 1040° C. well below the solidification temperature of the alloys. As a result, the cast dendritic beta structure is eliminated during the solid state cooling stage, leading to an (alpha+beta) platelet structure similar to typical wrought alloy. Further, the as-cast microstructure can be improved by means of post-cast cooling rate changes and subsequent heat treatment Titanium castings respond well to the process of elimination of porosity of internal casting defects by hot isostatic pressing (HIP). Both elimination of casting porosity and promotion of a favorable microstructure improve mechanical properties. However, the high reactivity of titanium, especially in the molten state, presents a special challenge to the foundry. Special, and sometimes relatively expensive, methods of melting, mold making, and surface cleaning may be required to maintain metal integrity.

Lost wax investment molding was the principal technology that allowed the proliferation of production of titanium casting. The adaptation of this method to titanium casting technology required the development of ceramic slurry materials having minimum reaction with the extremely reactive molten titanium.

The titanium casting industry is still in its early stage of development. Because of highly reactive characteristics of titanium with ceramic materials, expensive mold materials (yttrium, throe and zircon) are used to make investment molds for titanium castings. The titanium castings develop a contaminated surface layer due to reaction with hot ceramic mold and molten titanium. This surface layer needs to be removed by some expensive chemical milling in acidic solutions containing hydrofluoric acid. Strict EPA regulations have to be followed to pursue chemical milling.

For example, U.S. Pat. No. 5,630,465 to Feagin discloses ceramic shell molds made from yttria slurries, for casting reactive metals. This patent is incorporated herein by reference.

The use of graphite in investment molds has been described in U.S. Pat. Nos. 3,241,200; 3,243,733; 3,256,574; 3,266,106; 3,296,666 and 3,321,005 all to Lirones and all incorporated herein by reference. U.S. Pat. No. 3,257,692 to Operhall; U.S. Pat. No. 3,485,288 to Zusman et al.; and U.S. Pat. No. 3,389,743 to Morozov et al. disclose carbonaceous mold surface utilizing graphite powders and finely divided inorganic powders termed "stuccos" and are incorporated herein by reference.

U.S. Pat. No. 4,627,945 to Winkelbauer et al., incorporated herein by reference, discloses injection molding refractory shroud tubes made from alumina and from 1 to 30 weight percent calcined fluidized bed coke, as well as other ingredients. The '945 patent also discloses that it is known to make isostatically-pressed refractory shroud tubes from a mixture of alumina and from 15 to 30 weight percent flake graphite, as well as other ingredients.

III. PREFERRED OBJECTS OF THE PRESENT INVENTION

It is an object of the invention to cast alloys in isotropic graphite molds with the mold cavity coated with pyrolytic graphite.

It is another object of the present invention to cast nickel, cobalt and nickel-iron base superalloys in isotropic graphite molds with the mold cavity coated with pyrolytic graphite.

It is another object of the present invention to cast nickel aluminide alloys in isotropic graphite molds with the mold cavity coated with pyrolytic graphite.

It is another object of the present invention to cast stainless steels in isotropic graphite molds with the mold cavity coated with pyrolytic graphite.

It is another object of the present invention to cast titanium and titanium alloys in isotropic graphite molds with the mold cavity coated with pyrolytic graphite.

It is another object of the present invention to cast titanium aluminides in isotropic graphite molds coated with pyrolytic graphite.

It is another objective of the present invention to cast zirconium and zirconium aluminide alloys in isotropic graphite molds with the mold cavity coated with pyrolytic graphite.

It is another objective of the present invention to cast aluminum matrix composites reinforced with a high volume fraction of particulates and/or whiskers of one or more of compounds such as silicon carbide, aluminum titanium carbide and titanium diboride in an isotropic graphite mold with the mold cavity coated with pyrolytic graphite.

It is another object of the present invention to provide isotropic graphite molds with the mold cavity coated with pyrolytic graphite.

These and other objects of the present invention will be apparent from the following description.

IV. SUMMARY OF THE INVENTION

This invention relates to a process for making various metallic alloys such as nickel, cobalt and iron based superalloys, stainless steel alloys, titanium alloys, titanium aluminide alloys, zirconium alloys and zirconium aluminide alloys as engineering components by vacuum induction melting of the alloys and subsequent casting of the melt in graphite molds under vacuum. More particularly, this invention relates to the use of high density high strength isotropic graphite molds with the mold cavity having been coated with pyrolytic graphite. The pyrolytic graphite is made via the chemical vapor deposition (CVD) technique to have very high purity (containing negligible trace elements).

The invention relates to pyrolytic graphite coating on bulk isotropic graphite that acts as the main body of the mold. Pyrolytic graphite (PG) is a unique form of graphite manufactured by decomposition of a hydrocarbon gas at very high temperature in a vacuum furnace. The result is an ultra-pure product that is near theoretical density and extremely anisotropic. The process used to form pyrolytic graphite is known as the chemical vapor deposition (CVD) technique. The chemical vapor deposition is carried out by the decomposition of low molecular weight hydrocarbon gases at a temperature of 1700°–2200° C. The pyrolytic graphite deposited is annealed at temperatures in excess of 2600° C. and pressures in excess of 5 torr.

In particular the invention relates to a method of making cast shapes of a metallic alloy, comprising the steps of:

melting the alloy to form a melt under vacuum or partial pressure of inert gas;

pouring the melt of the alloy into the cavity of a composite mold which is made essentially of isotropic graphite having a machined mold cavity, wherein the surface of the mold cavity is coated with a pyrolytic graphite coating; and solidifying the melted alloy into a solid body taking the shape of the mold cavity.

Typically, the "c" direction of the pyrolytic graphite coating is perpendicular to the wall of the mold cavity and the pyrolytic graphite coating has a thickness between 0.1 to 5 mm. Also, typically the pyrolytic graphite has the following physical properties:

density of at least 2.1 gm/cc, porosity of at most 1%, compressive strength in the "c" direction of at least 65,000 psi at room temperature, and flexural strength in the "c" direction of at least 20,000 psi at room temperature.

Typically, the pyrolytic graphite has a density between 2.15 and 2.25 grams/cc and compressive strength between 65,000 psi and 70,000 psi and porosity less than 1%.

Attractive features of pyrolytic graphite include the following:

Chemically Inert

High Purity

Stable to 3000° C.

Impermeable

Directional Electrical and Thermal Characteristics

Self-Lubricating

Nondusting

To construct a typical composite mold of the present invention, a mold with split halves is fabricated out of a high density isotropic graphite by machining a mold cavity of the required design into the graphite. Subsequently, the mold cavity is coated with a coating of anisotropic pyrolytic graphite via a chemical deposition process (CVD).

The CVD process parameters are controlled such that the coating is formed with the "c" direction of the graphite structure lying perpendicular to the mold wall surface. The "c" direction is at right angles to the basal planes of the graphite structure consisting of layers of carbon atoms arranged in a precise hexagonal pattern. Anisotropic pyrolytic graphite uniformly deposited over the surface of the mold cavity with "c" direction perpendicular to the mold wall offers the following advantages:

very high compressive strength, extremely low thermal conductivity, and an extremely dense and impervious coating.

Moreover, the above described composite molds, i.e., isotropic graphite molds coated with pyrolytic graphite, can be used to fabricate castings of superalloys, stainless steels, titanium alloys, titanium aluminides, nickel aluminides and zirconium alloys with improved quality and superior mechanical properties compared to castings made by a conventional investment casting process.

The molds can be used repeatedly many times thereby reducing significantly the cost of fabrication of castings compared to traditional processes.

Near net shape parts can be cast, eliminating subsequent operating steps such as machining.

As discussed above, the composite mold is made by a process including machining a cavity into a monolithic block of isotropic graphite and then coating at least the surface of the cavity with pyrolytic graphite. In the alternative, the isotropic graphite substrate can be initially molded to have the cavity and then have at least the surface of the cavity coated with pyrolytic graphite.

If desired, the composite mold may include a first substrate layer, a second substrate layer located over the first substrate layer and defining a cavity, and a layer of pyrolytic graphite coating at least the cavity of the second substrate layer. The second substrate layer would consist essentially of isotropic graphite. The first substrate layer may be made of any material which does not significantly interfere with operation of the mold. For example, a potential material for the first substrate layer may be extruded graphite.

Construction of composite graphite molds according to the present invention is more economical than the expensive process of fabricating a mold by machining a cavity into a monolithic block of pyrolytic graphite formed by a CVD process.

The mold of an isotropic graphite substrate coated with pyrolytic graphite would be more long lasting and perform better than a mold made of an extruded graphite substrate coated with pyrolytic graphite.

V. BRIEF DESCRIPTION OF THE DRAWINGS

Figure 12:
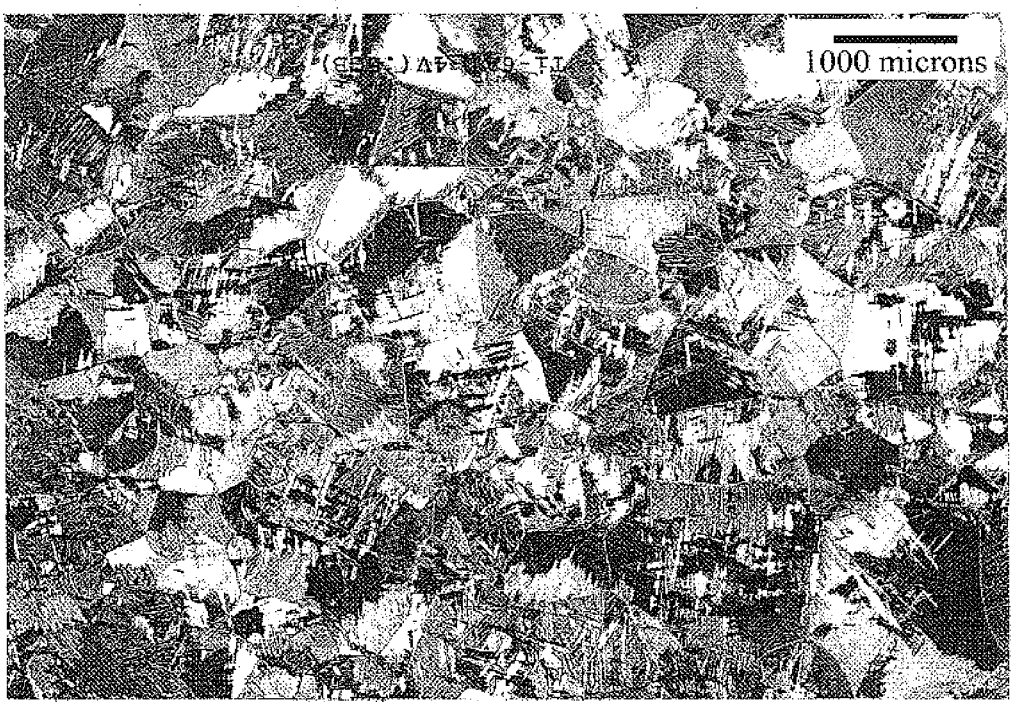

FIG. 12 exhibits the uniform microstructure of the bulk area of a sample of Example 6 taken from a 0.5 inch thick Ti-6Al-4V step plate cast in the isotropic graphite mold coated via CVD with pyrolytic graphite of Example 4.

Figure 13B:
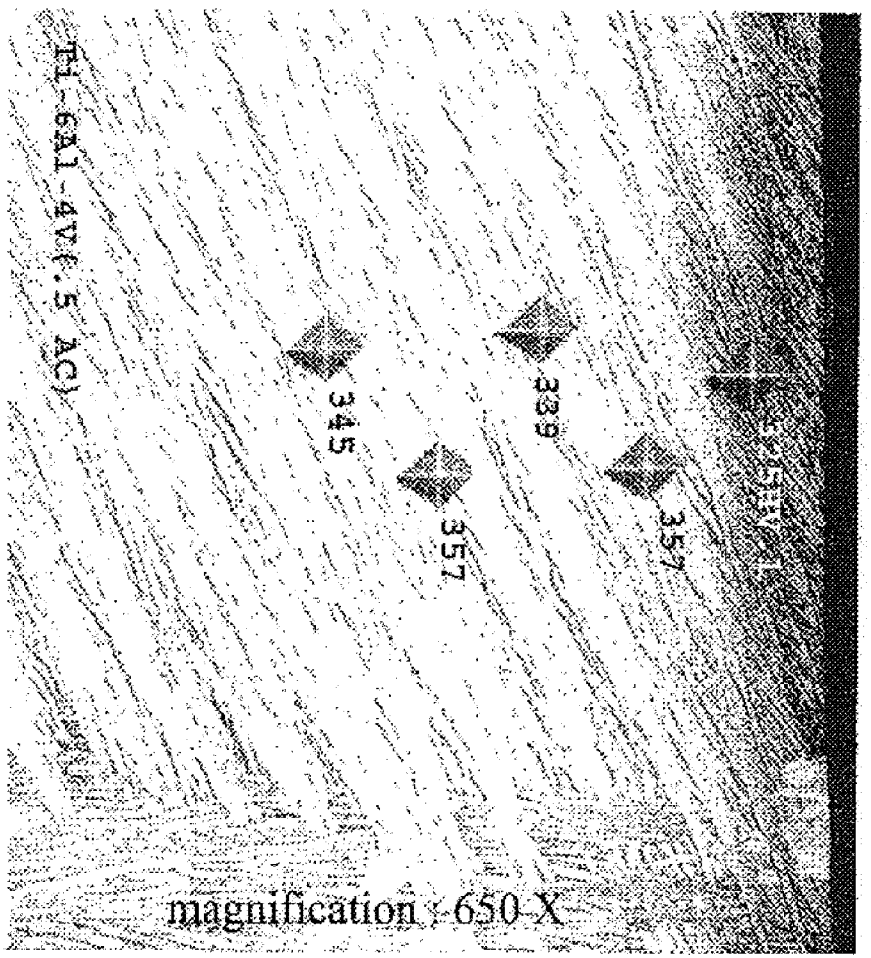
Figure 13A:
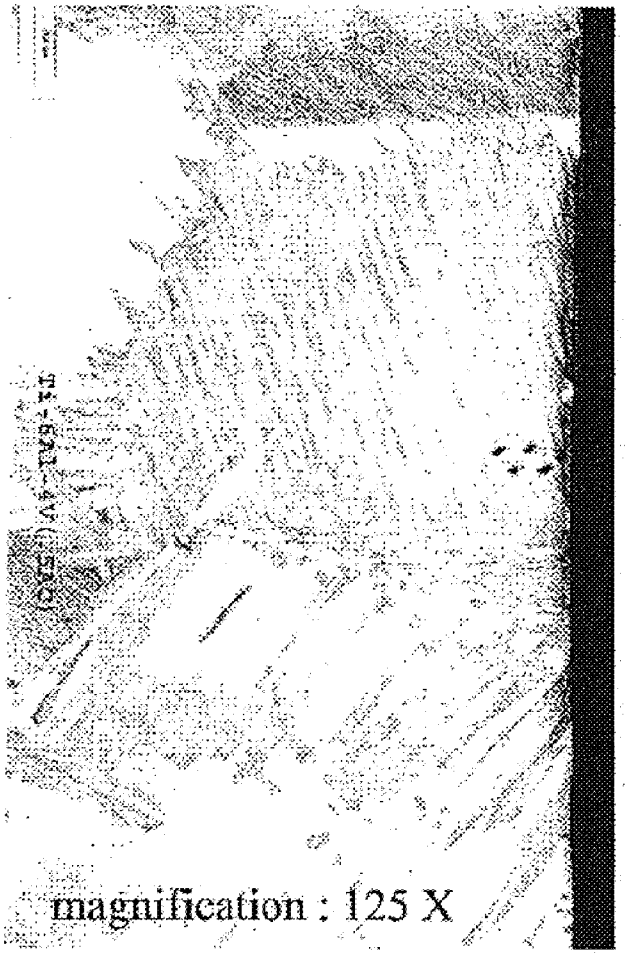

FIGS. 13A and 13B exhibit the microstructures of the sample of FIG. 12 at 125× and 650×, respectively.

Figure 14:
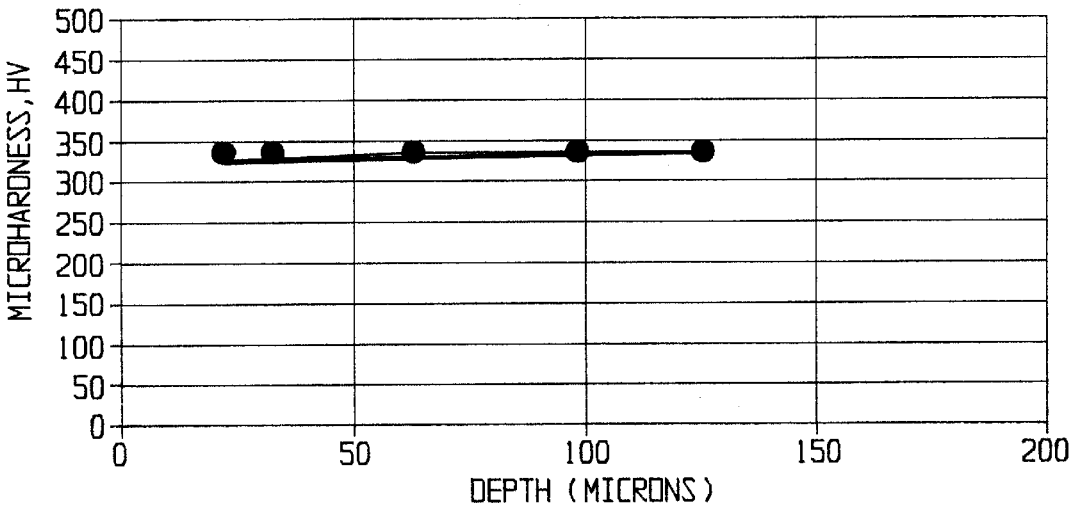

FIG. 14 shows the microhardness profile of the sample of FIG. 12 as a function of depth from the surface towards inside area.

Figure 15B:
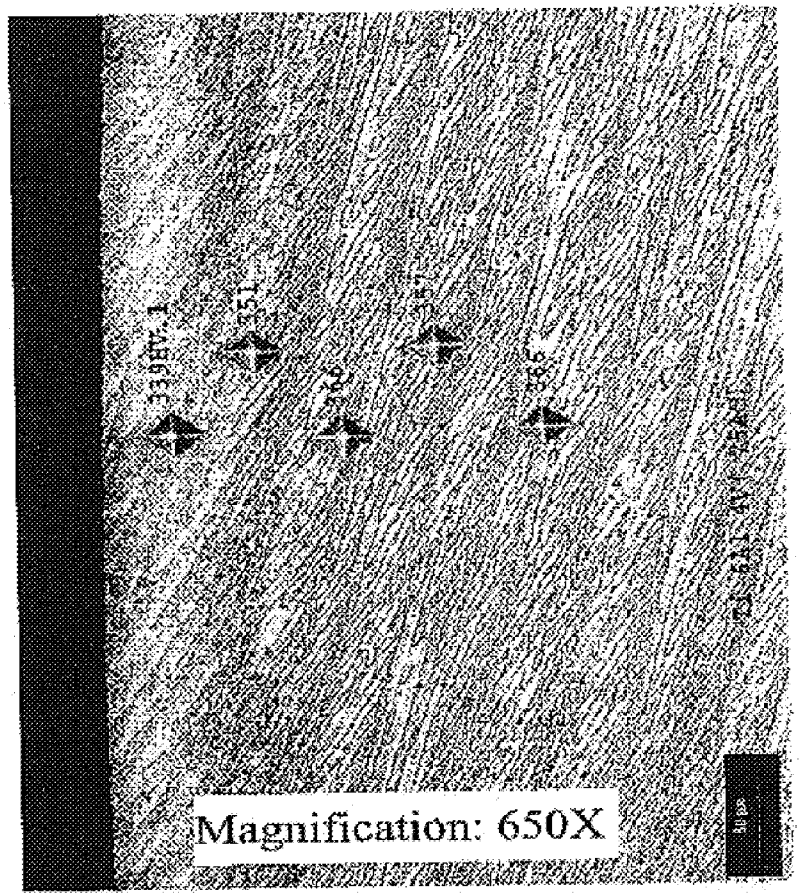
Figure 15A:
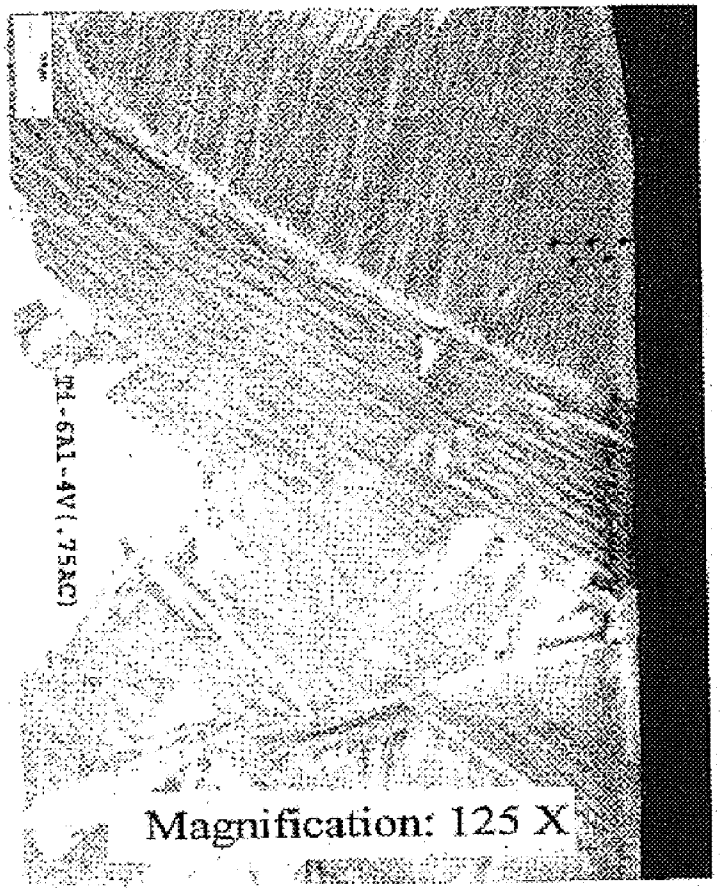

FIGS. 15A and 15B show the microstructures of a sample of Example 6 taken from a 0.75 inch thick plate of Ti-6Al-4V cast in a pyrolytic graphite coated mold at magnifications, 125× and 650×, respectively.

Figure 16:
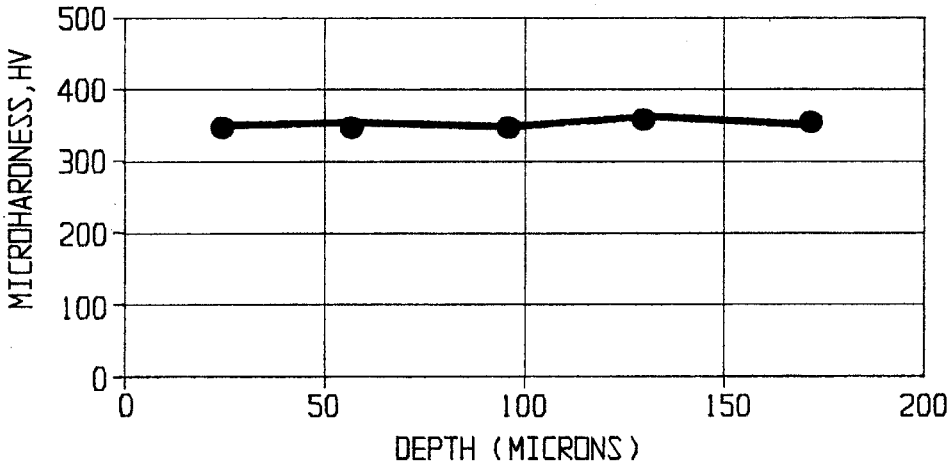

FIG. 16 shows the microhardness profile of the sample of FIGS. 15A and 15B as a function of depth from the surface towards inside area.

Figure 17B:
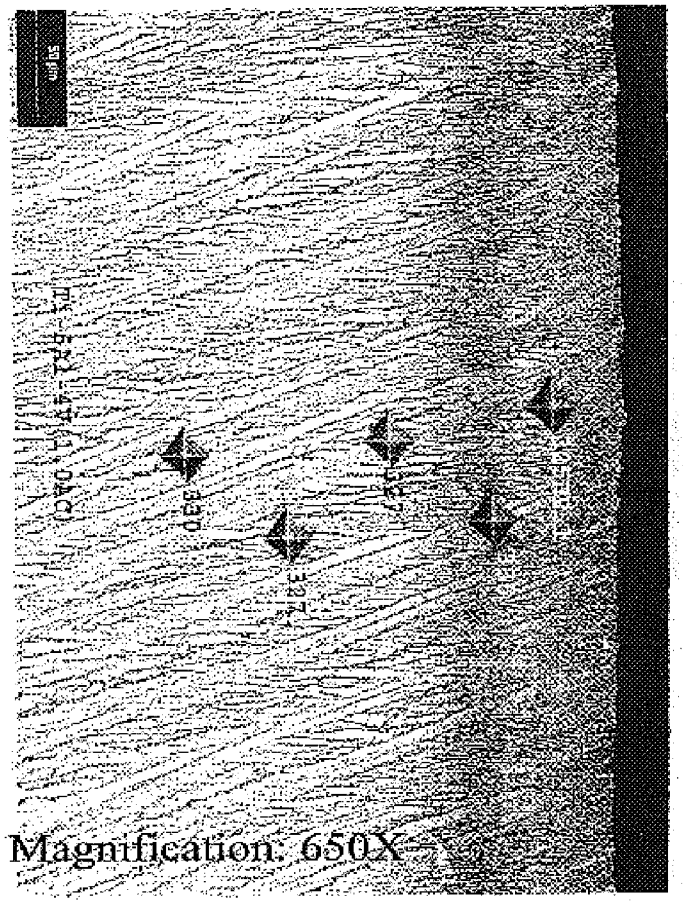
Figure 17A:
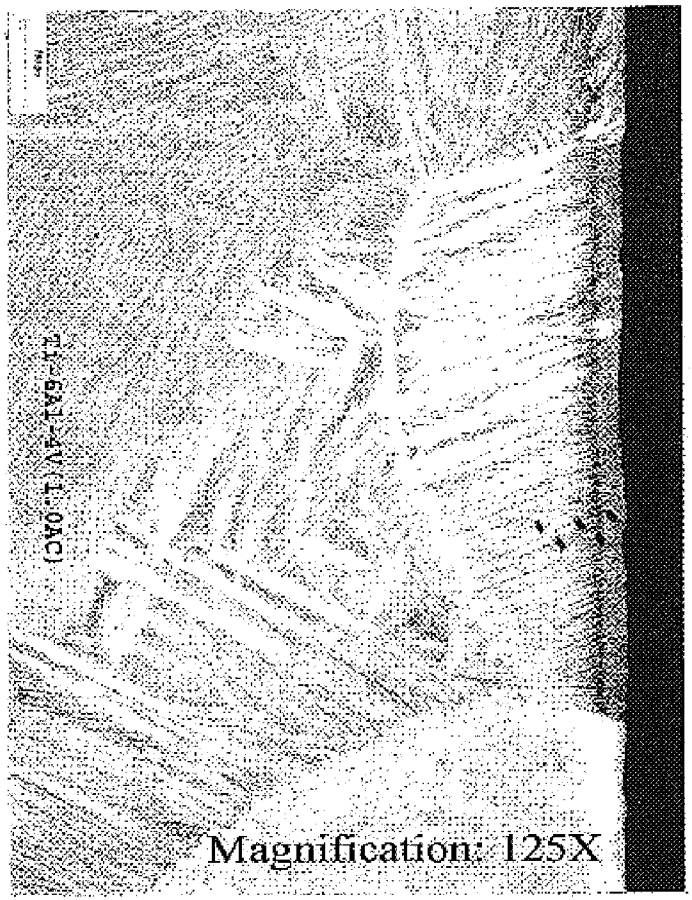

FIGS. 17A and 17B show the microstructures of a sample of Example 6 taken from a 1 inch thick plate of Ti-6Al-4V cast in pyrolytic graphite coated mold at magnifications, 125× and 650×, respectively.

Figure 18:
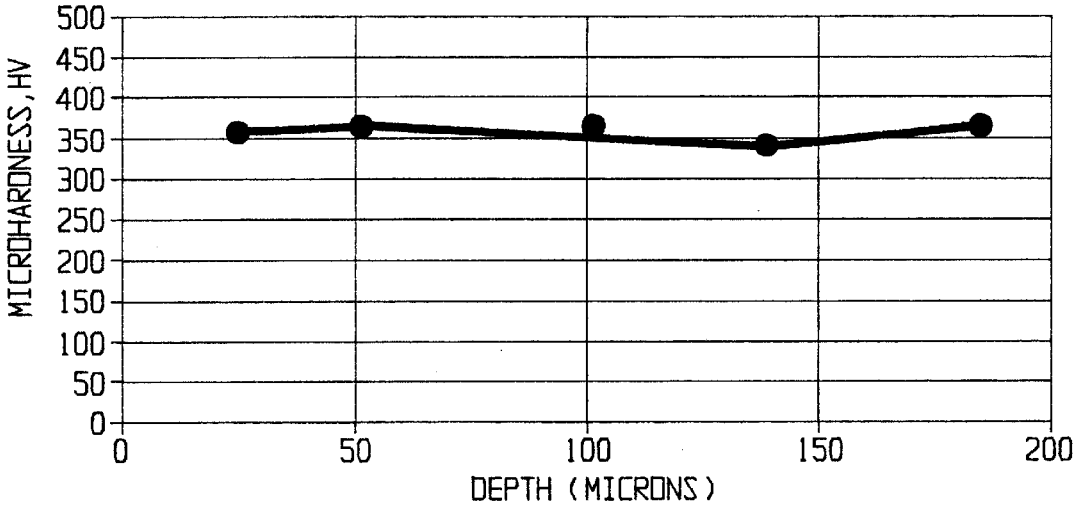

FIG. 18 shows the microhardness profile of the sample of FIGS. 17A and 17B as a function of depth from the surface towards inside area.

Figure 19B:
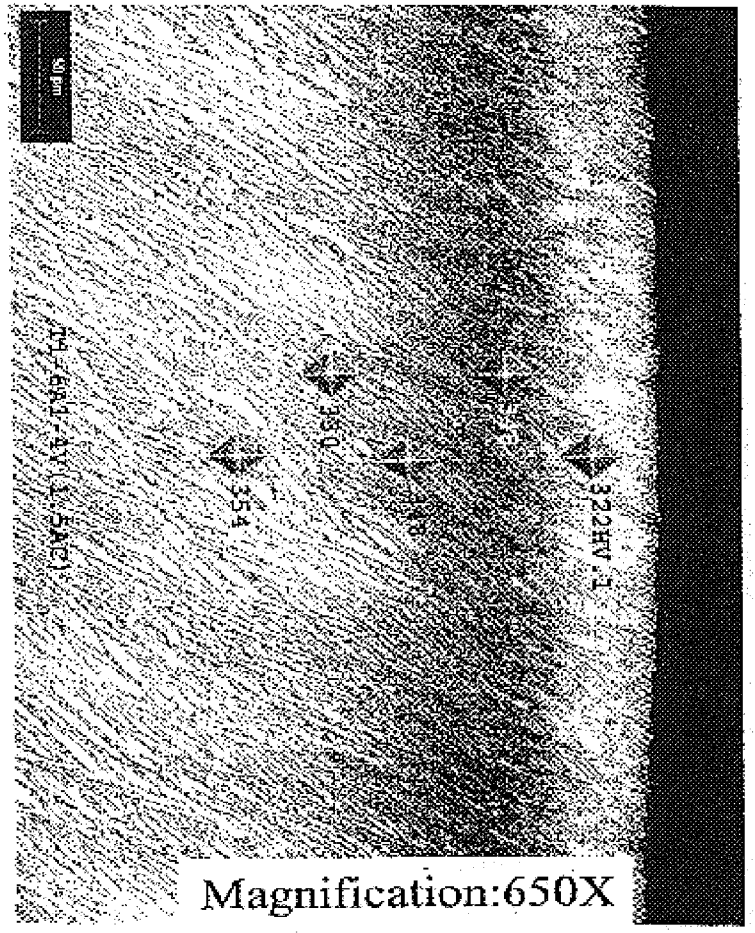
Figure 19A:
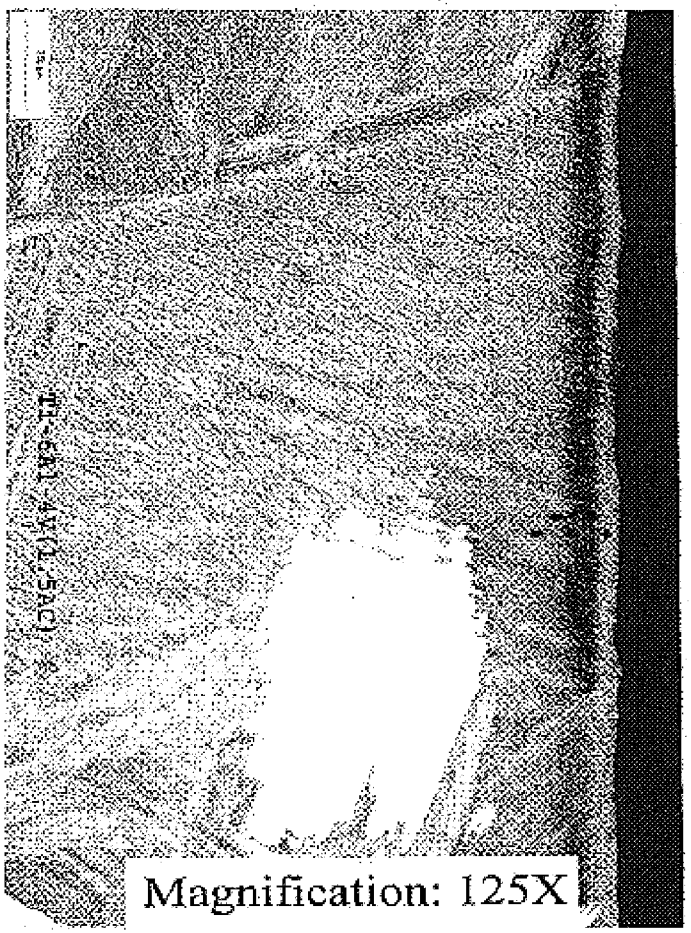

FIG. 19A and FIG. 19B show the microstructures of a sample of Example 6 taken from a 1.5 inch thick plate of Ti-6Al-4V cast in pyrolytic graphite coated mold at magnifications, 125× and 650× respectively.

Figure 20:
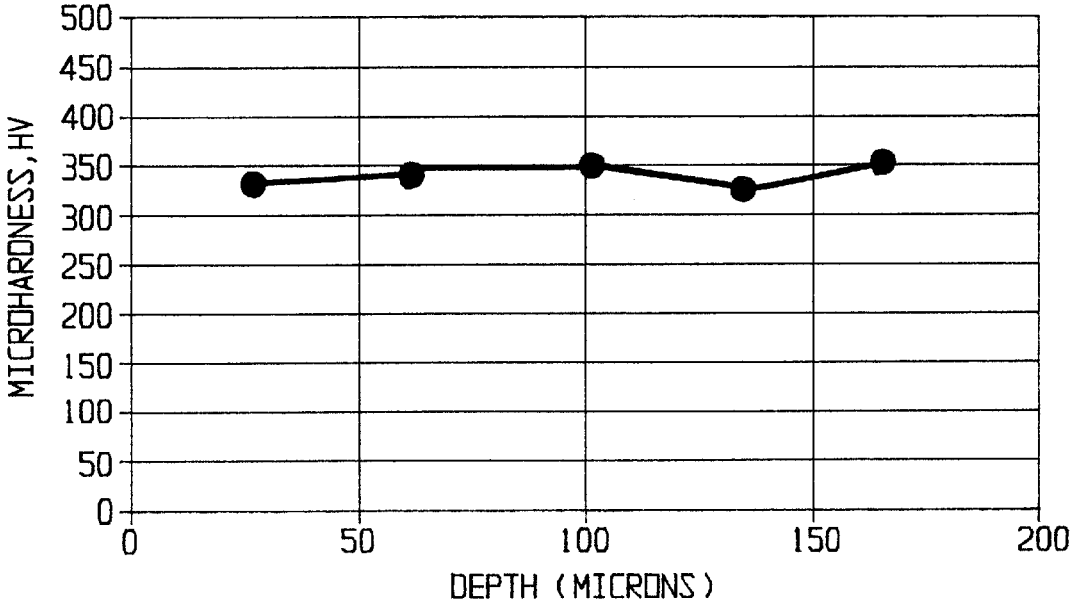

FIG. 20 shows the microhardness profile of the sample of FIG. 19A and FIG. 19B as a function of depth from the surface towards inside area.

VI. DETAILED DESCRIPTION OF THE PREFERRED EMBODIMENTS

A. Graphite Molds

Figure 1:
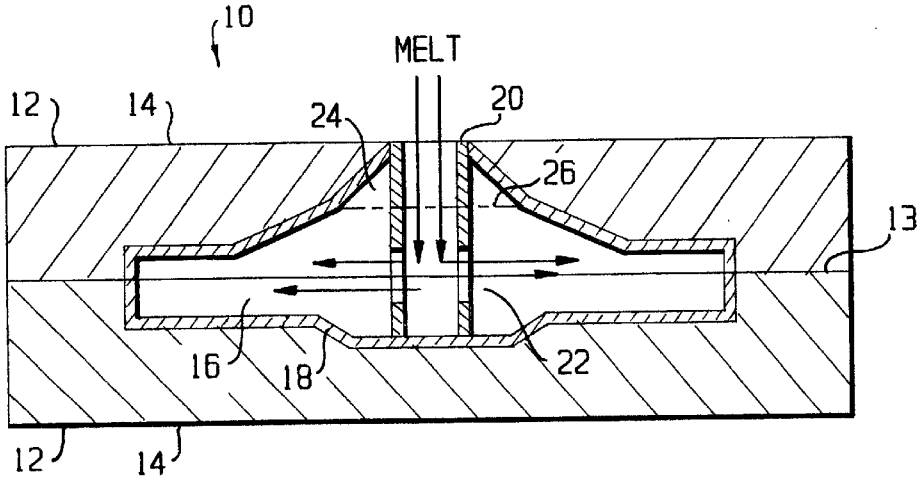
FIG. 1 shows a schematic of an embodiment of a mold of the present invention.

FIG. 1 shows an embodiment of a composite graphite mold 10 of the present invention. The mold 10 has two halves 12. The border between the two halves 12 is shown as a parting line 13. Each half 12 made of a substrate 14 of isotropic graphite with a machined mold cavity 16 onto which a pyrolytic graphite coating 18 of a desirable thickness is deposited with the "c" direction perpendicular to the mold wall. The coating thickness is maintained from 0.1 to 5 mm, preferably 0.5 to 5 mm, and more preferably 1 to 3 mm. As shown, the pyrolytic graphite coating 18 is directly coated onto the isotropic graphite substrate 14. The mold 10 also has a core 20. The core 20 is an isotropic graphite cylinder. The core 20 has holes 22 (also known as a gate) for flowing the alloy "MELT" there through into the cavity 16. Molten metal shrinks as it cools. Thus, the mold 10 has a riser section 24 for excess metal. After the metal cools the excess metal is removed to the dashed line 26 by cutting or other appropriate machining.

1. Pyrolytic Graphite

Pyrolytic graphite (PG) is a unique form of graphite manufactured by decomposition of a hydrocarbon gas at very high temperature in a vacuum furnace. The result is an ultra-pure product that is near theoretical density and extremely anisotropic. The process used to form pyrolytic graphite is known as the chemical vapor deposition (CVD) technique. The chemical vapor deposition is carried out by the decomposition of low molecular weight hydrocarbon gases at a temperature of 1700°–2200° C. The pyrolytic graphite deposited is annealed at temperatures in excess of 2600° C. and pressures in excess of 5 torr.

U.S. Pat. No. 4,608,192 issued Aug. 28, 1986, and incorporated herein by reference, describes a process for forming graphite intercalates containing metal charge transfer salts.

U.S. Pat. No. 3,900,540 issued Aug. 19, 1975, and incorporated herein by reference, describes a method for preparing a thin film of substantially defect-free pyrolytic graphite by vapor deposition on an inert liquid substrate surface followed by separation of the graphite.

U.S. Pat. No. 3,547,676 issued Dec. 15, 1970, and incorporated herein by reference, describes the preparation of pyrolytic carbon structures by chemical vapor deposition from a mixture of methane and inert gas at a temperature of about 2100° C.

Having been synthesized from purified hydrocarbon gases, total metallic impurities of PG are exceptionally low, on the order of <5 ppm. PG performs well at exceptionally high temperatures and is stable at temperatures as high as 2200° C. Due to the nature of the deposition process by CVD, PG approaches the theoretical density of carbon, namely 2.2 grams per cc, and hence is essentially non-porous (out-gassing occurs quickly). Thus, the PG coating has a density of at least about 2.1 grams per cc, typically at least about 2.15 grams per cc, preferably between about 2.15 and 2.25 grams per cc. Typically PG has compressive strength between 65,000 psi and 70,000 psi and porosity less than 1%.

The anisotropic conductivity of PG has excellent conductivity, approaching copper in the horizontal plane, whereas it acts almost as a ceramic along the vertical direction, requiring special fixturing to take maximum advantage of its directional conductivity.

Mechanical thermal, and electrical properties are generally far superior to conventional graphite. PG is available as plate, free-standing shapes (crucibles, tubes, etc.) and as an impermeable coating on graphite or other substrate. TABLE 1 gives typical properties of pyrolytic graphite.

TABLE 1

TYPICAL PROPERTIES OF PYROLYTIC GRAPHITE

| Property | Direction* | Metric Units | English Units |
|---|---|---|---|
| Density | — | 2.22 g/cc | 137 lb/ft$^3$ |
| Flexural Strength | | | |
| at Room Temperature | a | 840 kg/cm$^2$ | 12,000 psi |
| | c | 1,750 Kg/cm$^2$ | 25,000 psi |
| Compressive Strength | | | |
| at Room Temperature | a | 1,050 kg/cm$^2$ | 15,000 psi |
| at Room Temperature | c | 4,550 Kg/cm$^2$ | 65,000 psi |
| Shear Strength | | | |
| at Room Temperature | a | 70 kg/cm2 | 1,000 psi |
| Coefficient Thermal Expansion | | | |
| at Room Temperature | a | $1.0 \times 10^{-6}$ cm/cm ° C. | 1.0 × 10−6 in/in ° F. |
| at 2200° C. | a | $0.67 \times 10^{-6}$ cm/cm ° C. | 1.2 × 10−6 in/in ° F. |
| at Room Temperature | c | $1.0 \times 10^{-6}$ cm/cm ° C. | 1.0 × 10−6 in/in ° F. |
| at 2200° C. | c | $8.0 \times 10^{-6}$ cm/cm ° C. | 14.7 × 10−6 in/in ° F. |
| Thermal Conductivity | | | |
| at Room Temperature | a | 345 W/m °K | 200 BTU/(hr ft$^2$)(° F./ft) |
| at 1650° C. | a | 114 W/m °K | 66 BTU/(hr ft$^2$)(° F./ft) |
| at Room Temperature | c | 1.73 W/m °K | 1.00 BTU/(hr ft$^2$)(° F./ft) |
| at 3000° F. | c | 1.30 W/m °K | 0.75 BTU/(hr ft$^2$)(° F./ft) |
| Shore Hardness | a | 103 | 103 |
| | c | 68 | 68 |
| Oxidation Threshold | | 650° C. | 1200° F. |
| Crystal Structure | | Hexagonal | |
| (C/2 Spacing) | | (3.42 Å) | |
| Melting Point (Atmosphere) | | Sublimes at 3650° C. | |
| Purity | | | |
| Total Impurities | | 0.01% Maximum | |
| Total Metallic | | 10 ppm | |
| Outgassing | | Negligible | |

*In TABLE 1, Parameters "a" and "b" are directions parallel to the basal plane of the graphite crystals in the pyrolytic graphite coating. In the present case, these two directions, though ninety degrees apart from each other, reside in the plane of the coating and are parallel to the mold wall. The "c" direction is perpendicular to the basal planes and therefore, perpendicular to the mold wall.

2. Isotropic Graphite

Isotropic graphite is the preferred material as the main body (substrate) of the composite mold of the present invention for the following reasons.

Isotropic graphite made via isostatic pressing has fine grains (3–40 microns) whereas extruded graphite is produced from relative coarse carbon particles resulting in coarse grains (400–1200 microns). Isotropic fine grained graphite has much higher strength, and structural integrity than extruded graphite due to the presence of fine grains, higher density and lower porosity.

Isotropic fine grained graphite can be machined with a very smooth surface compared to extruded graphite due to its high hardness, fine grains and low porosity. Pyrolytic graphite coating deposited over an extremely smooth machined surface of isotropic graphite will have a very smooth finish with uniform thickness and will be desirable for producing castings of superalloys and titanium.

Density is the ratio of the mass to the volume of material including open and closed pores. Density is measured according to ASTM C-838.

Compressive properties describe the behavior of a material when it is subjected to a compressive load. Loading is at a relatively low and uniform rate. Compressive strength and modulus are the two most common values produced.

Compressive strength is stress required to cause ultimate fracture under compressive load. Test procedures correspond to ASTM C-695. The specimen is placed between compressive plates parallel to the surface. The specimen is then compressed at a uniform rate. The maximum load is recorded along with stress-strain data. An extensometer attached to the front of the fixture is used to determine modulus.

Specimens can either be blocks or cylinders. The typical blocks are 12.7×12.7×25.4 mm (½ by ½ by 1 in). and the cylinders are 12.7 mm (½ in) in diameter and 25.4 mm (1 in) long.

Compressive strength and modulus are two useful calculations.

Compressive strength=maximum compressive load/minimum cross sectional area.

Compressive modulus=change in stress/change in strain.

Flexural strength of graphite is the maximum stress that a sample will withstand in bending before rupture. Graphite is typically tested using four-point loading according to the ASTM C 651.

Flexural modulus is used as an indication of a material's stiffness when flexed.

Most commonly the specimen lies on a support span and the load is applied to the center by the loading nose producing three point bending at a specified rate.

The parameters for this test are the support span; the speed of the loading; and the maximum deflection for the test. A variety of specimen shapes can be used for this test, but the most commonly used specimen size is 3.2 mm×12.7 mm×64 mm (0.125"×0.5"×2.5") for measurement of flexural strength, flexural stress at specified strain levels, and flexural modulus.

Apparent porosity is the ratio of the volume of open pores to the apparent total volume of the material expressed as a percentage. This corresponds to ASTM C-830.

References relating to isotropic graphite include U.S. Pat. No. 4,226,900 to Carlson, et al, U.S. Pat. No. 5,525,276 to Okuyama et al, and U.S. Pat. No. 5,705,139 to Stiller, et al., as well as U.S. provisional patent applications Ser. Nos. 60/290,647 filed May 15, 2001 and 60/296,771 filed Jun. 11, 2001, and U.S. patent application Ser. No. 10/143,920, filed May 14, 3002, all of these references are incorporated herein by reference in their entirety.

The isotropic graphite of the main body (substrate) of the mold is typically high density ultrafine grained graphite, and is of very high purity (containing negligible trace elements). It is typically made via the isostatic pressing route. Typically, the isotropic graphite of the main body has been isostatically or vibrationally molded and has ultra fine isotropic grains between 3–40 microns, a density between 1.65–1.9 grams/cc (preferably 1.77–1.9 grams/cc), flexural strength between 5,500 and 20,000 psi (preferably between 7,000 and 20,000 psi), compressive strength between 9,000 and 35,000 psi, typically between 12,000 and 35,000 psi (preferably between 17,000 and 35,000 psi), and porosity below 15% (preferably below 13%).

Other important properties of the isotropic graphite material are high thermal shock, wear and chemical resistance, and minimum wetting by liquid metal.

In contrast, extruded graphite which has lower density (<1.72 gm/cc), lower flexural strength (<3,000 psi), high porosity (>20%), and lower compressive strength (<8,000 psi) have been found to be less suitable as molds for casting iron, nickel and cobalt base superalloys.

Also, isotropic graphite made via isostatic pressing has fine grains (3–40 microns) whereas extruded graphite is produced from relative coarse carbon particles resulting into coarse grains (400–1200 microns). Isostropic graphite has much higher strength, and structural integrity than extruded graphite due to the presence of extremely fine grains, higher density and lower porosity, as well as the absence of "loosely bonded" carbon particles. Extruded graphite has higher thermal conductivity due to anisotropic grain structure formed during extrusion.

Another premium grade of graphite suitable for use as the main body for permanent molds for casting various superalloys, titanium and titanium aluminide alloys with high quality is a copper impregnated "isostatic" graphite, R8650C from SGL Graphite Company. It has excellent density, microfine grain size and can be machined/ground to an extremely smooth finish.

Another grade of graphite suitable for use as the main body for permanent molds for casting superalloys, titanium, titanium alloys and titanium aluminides, nickel aluminides is isotropic fine grained graphite made by vibration molding.

Isotropic fine grained graphite is synthetic material produced by the following steps:

(1) Fine grained coke extracted from mines is pulverized, separated from ashes and purified by flotation techniques. The crushed coke is mixed with binders (tar) and homogenized.

(2) The mixture is isostatically pressed into green compacts at room temperature (3) The green compacts are baked at 1200° C. causing carbonizing and densification. The binder is converted into carbon. The baking process binds the original carbon particles together (similar to the process of sintering of metal powders) into a solid mass.

(4) The densified carbon part is then graphitized at 2600° C. Graphitization is the formation of ordered graphite lattice from carbon. The carbon from the binder around the grain boundaries is also converted in graphite. The final product is nearly 100% graphite (the carbon from the binder is all converted in graphite during graphitization)

Extruded anisotropic graphite is synthesized according to the following steps;

(1) Coarse grain coke (pulverized and purified) is mixed with pitch and warm extruded into green compacts.

(2) The green compacts are baked at 1200° C. (carbonization and densification). The binder (pitch is carbonized)

(3) The baked compact is graphitized into products that are highly porous and structurally weak. It is impregnated with pitch to fill the pores and improve the strength.

(4) The impregnated graphite is baked again at 1200° C. to carbonize the pitch (5) The final product (extruded graphite) contains ~90–95% graphite and ~5–10% loosely bonded carbon.

When liquid metal is poured into the graphite molds, the mold wall/melt interface is subjected to shear and compressive stresses which can fracture graphite at the interface. Any graphite particles and "loosely bonded carbon mass" plucked away from the mold wall are absorbed into the hot melt and begin to react with oxide particles in the melt and generate carbon dioxide gas bubbles. These gas bubbles coalesce and get trapped as porosity into the solidified castings. Pyrolytic graphite coating due to its high density, near zero porosity, and high compressive and flexural strength suffers negligible mechanical damage at the mold wall/melt interface during the casting process. The castings produced in molds coated with pyrolytic graphite have excellent surface quality and mechanical integrity.

Properties of various grades of graphite that influence the quality of the castings are high strength, high density and low porosity. Key properties of pyrolytic graphite, isotropic graphite and extruded graphite are listed in TABLES 2, 3 and 4.

TABLE 2

(PROPERTIES OF PYROLYTIC GRAPHITE MADE VIA CHEMICAL VAPOR DEPOSITION)

| Density Gm/cc | Flexural Strength (psi) | Compressive Strength (psi) | Grain Size (microns) | Thermal Conductivity (BTU/ft-hr-F.) | Porosity (open) |
|---|---|---|---|---|---|
| 2.18 | >21,000 | 67,000 | — | 0.81 | <1% |

TABLE 3

(PROPERTIES OF ISOTROPIC GRAPHITE MADE VIA ISOSTATIC PRESSING)

| Grade | Density Gm/cc | Flexural Strength (psi) | Compressive Strength (psi) | Grain Size (microns) | Thermal Conductivity (BTU/ft-hr-F.) | Porosity (open) |
|---|---|---|---|---|---|---|
| R8500 | 1.77 | 7250 | 17,400 | 6 | 46 | 13% |
| R8650 | 1.84 | 9400 | 21,750 | 5 | 52 | 12% |
| R8710 | 1.88 | 12300 | 34,800 | 3 | 58 | 10% |

TABLE 4

(PROPERTIES OF ANISOTROPIC GRAPHITE MADE VIA EXTRUSION)

| Grade | Density Gm/cc | Flexural Strength (psi) | Compressive Strength (psi) | Grain Size (microns) | Thermal Conductivity (BTU/ft-hr-F.) | Porosity (open) |
|---|---|---|---|---|---|---|
| HLM | 1.72 | 3500 | 7500 | 410 | 86 | 23% |
| HLR | 1.64 | 1750 | 4500 | 760 | 85 | 27% |

Low thermal conductivity along the "c" direction of pyrolytic graphite coating which is perpendicular to the mold wall will allow heat transfer from the molten metal through the mold wall at a considerably slow rate. Due to the thermal insulation created by the pyrolytic graphite coating, the melt remains highly fluid while the mold cavity is being filled and the fluid melt will flow well and not prematurely solidify before filling up areas with narrow cross sections. The slow cooling rate will produce highly coarser grain sizes leading to development of superior stress rupture properties in many nickel base superalloys intended for high temperature applications.

3. Making the Mold

In accordance with a preferred embodiment of the present invention, in a first step the substrate, which is the isotropic graphite mold with a machined cavity of the desired shape, is positioned in a furnace and the furnace chamber is evacuated to a pressure in the order of 1 mm Hg. When the pressure is reduced to about 1 mm Hg the furnace is heated to about 700°–1000° C. at a rate of about 300 to 400° C. per hour.

When the temperature is reached it may be desirable to pass hydrogen gas through the furnace at a rate of about 15–25 standard cubic feet per hour. The heat up of the furnace is continued at a rate of about 300 to 400° C./hr until a temperature of about 1800 to 2250° C. is reached. When this temperature is reached the hydrogen flow, where hydrogen is used, is discontinued and low molecular weight hydrocarbon gases, e.g., methane or ethane, at a temperature of 1700 to 2200° C. are passed through the furnace to form pyrolytic graphite by the chemical vapor deposition (CVD) technique. For example, methane is passed through the furnace at a flow rate of about of 30–40 standard cubic feet per hour. When the temperature and gas flow are stabilized at about 2100° C. and 36 standard cubic feet per hour the pressure in the furnace is increased to about 5 torr±1.5 torr. These conditions are maintained until the deposit of pyrolytic graphite of a desired thickness is achieved on the entire surface of the mold cavity. Typical thickness ranges from about 0.1 to about 5 mm, preferably about 0.5 to about 5 mm, and more preferably about 1 to about 3 mm.

The CVD process parameters are controlled such that the coating is directly deposited on the isotropic graphite and formed with the "c" direction of the graphite structure lying perpendicular to the mold wall surface. The "c" direction is at right angles to the basal planes of the graphite structure consisting of layers of carbon atoms arranged in a precise hexagonal pattern.

The pyrolytic graphite deposited is annealed at temperatures in excess of 2600° C. and pressures in excess of 5 torr.

B. Alloys

There are a variety of superalloys.

Nickel base superalloys contain 10–20% Cr, up to about 8% Al and/or Ti, and one or more elements in small amounts (0.1–12% total) such as B, C and/or Zr, as well as small amounts (0.1–12% total) of one or more alloying elements such as Mo, Nb, W, Ta, Co, Re, Hf, and Fe. There may also several trace elements such as Mn, Si, P, S, O and N that must be controlled through good melting practices. There may also be inevitable impurity elements, wherein the impurity elements are less than 0.05% each and less than 0.15% total. Unless otherwise specified, all % compositions in the present description are weight percents.

Cobalt base superalloys are less complex than nickel base superalloys and typically contain 10–30% Cr, 5–25% Ni and 2–15% W and small amounts (0.1–12% total) of one or more other elements such as Al, Ti, Nb, Mo, Fe, C, Hf, Ta, and Zr. There may also be inevitable impurity elements, wherein the impurity elements are less than 0.05% each and less than 0.15% total.

Nickel-iron base superalloys contain 25–45% Ni, 37–64% Fe, 10–15% Cr, 0.5–3% Al and/or Ti, and small amounts (0.1–12% total) of one or more elements such as B, C, Mo, Nb, and W. There may also be inevitable impurity elements, wherein the impurity elements are less than 0.05% each and less than 0.15% total.

The invention is also advantageous for use with stainless steel alloys based on Fe primarily containing 10–30%Cr and 5–25% In, and small amounts (0.1–12%) of one or more other elements such as Mo, Ta, W, Ti, Al, Hf, Zr, Re, C, B and V, etc. and inevitable impurity elements, wherein the impurity elements are less than 0.05% each and less than 0.15% total.

The invention is also advantageous for use with metallic alloys based on titanium. Such alloys generally contain at least about 50% Ti and at least one other element selected from the group consisting of Al, V, Cr, Mo, Sn, Si, Zr, Cu, C, B, Fe and Mo, and inevitable impurity elements, wherein the impurity elements are less than 0.05% each and less than 0.15% total.

Suitable metallic alloys also include alloys based on titanium and aluminum known as titanium aluminides which typically contain 50–85% titanium, 15–36% Al, and at least one other element selected from the group consisting of Cr, Nb, V, Mo, Si and Zr and inevitable impurity elements, wherein the impurity elements are less than 0.05% each and less than 0.15% total.

The invention is also advantageous for use with metallic alloys based on at least 50% zirconium and which contain at least one other element selected from the group consisting of Al, V, Mo, Sn, Si, Ti, Hf, Cu, C, Fe and Mo and inevitable impurity elements, wherein the impurity elements are less than 0.05% each and less than 0.15% total.

The invention is also advantageous for use with metallic alloys based on nickel and aluminum commonly known as nickel aluminides. These alloys contain at least 50% nickel, 20–40% Al and optionally at least one other element selected from the group consisting of V, Si, Zr, Cu, C, Fe and Mo and inevitable impurity elements, wherein the impurity elements are less than 0.05% each and less than 0.15% total.

The invention is also advantageous for use aluminum matrix composites containing 20 to 60 volume percent of hard ceramic particulate or whiskers of one or more of the compounds such as silicon carbide, aluminum oxide, titanium carbide or titanium diboride.

C. Use of the Mold

An alloy is melted by any conventional process that achieves uniform melting and does not oxidize or otherwise harm the alloy. For example, a preferred heating method is vacuum induction melting. Vacuum induction melting is a known alloy melting process as described in the following references, all of which are incorporated herein by reference:

D. P. Moon et al, ASTM Data Series DS 7-SI, 1-350 (1953)

M. C. Hebeisen et al, NASA SP-5095, 31-42 (1971)

R. Schlatter, "Vacuum Induction Melting Technology of High Temperature Alloys", Proceedings of the AIME Electric Furnace Conference, Toronto (1971).

Examples of other suitable heating processes include the "plasma vacuum arc remelting" technique and induction skull melting.

Preferably the molds are kept heated (200–800° C.) in the mold chamber of the vacuum furnace prior to the casting of melt in the molds. This heating is particularly important for casing complex shapes. The molds can be also kept at ambient temperatures for casting simple shapes. Typical preferred ranges for keeping the molds heated are between 150 and 800° C., between 200 and 800° C., between 150 and 450° C., and between 250 and 450° C.

The candidate iron, nickel and cobalt base superalloys are melted in vacuum by an induction melting technique and the liquid metal is poured under full or partial vacuum into the heated or unheated graphite mold. In some instances of partial vacuum, the liquid metal is poured under a partial pressure of inert gas. The molding then occurs under full or partial vacuum.

High purity and high density of the composite mold material of the present invention enhances non-reactivity of the mold surface with respect to the liquid melt during solidification. As a consequence, the process of the present invention produces a casting having a very smooth high quality surface as compared to the conventional ceramic mold investment casting process. The pyrolytic graphite molds show very little reaction with molten superalloys, titanium alloys and stainless steels and suffer minimal wear and erosion after use and hence, can be used repeatedly over many times to fabricate castings of the alloys with high quality. Whereas the conventional investment casting molds are used one time for fabrication of superalloy, stainless steel, titanium and titanium aluminide alloy castings. The present invention is particularly suitable for fabricating highly alloyed nickel, cobalt and iron base superalloys, titanium alloys and titanium aluminide alloys which are difficult to fabricate by other processes such as forging or machining. Such alloys can be fabricated in accordance with the present invention as near net shaped or net shaped components thereby minimizing subsequent machining operations.

Furthermore, the coarse grain structures of the castings resulting from the slow cooling rates experienced by the melt will lead to improved mechanical properties such as high stress rupture strength for many nickel base superalloys suitable for applications as jet engine components.

For example, the present invention may be used to make castings for a wide variety of titanium alloy products. Typical products include titanium alloy products for the aerospace, chemical and energy industries, medical prosthesis, and/or golf club heads. Typical medical prosthesis include surgical implants, for example, plates, pins and artificial joints (for example hip implants or jaw implants). The present invention may also be used to make golf club heads.

According to an embodiment of the present invention, titanium alloys and titanium aluminide alloys are induction melted in a water cooled copper crucible or yttrium oxide crucible and are cast in high density, high strength ultrafine grained isotropic graphite molds coated with pyrolytic graphite.

Furthermore, titanium alloys can be melted in water-cooled copper crucible via the "plasma vacuum arc remelting" technique. The castings are produced with high quality surface and dimensional tolerances free from casting defects and contamination. Use of the casting process according to the present invention eliminates the necessity of chemical milling to clean the contaminated surface layer on the casting as commonly present in titanium castings produced by the conventional investment casting method. Since the pyrolytic graphite coated molds do not react with the titanium melt and show no sign of erosion and damage, the molds can be used repeatedly numerous times to lower the cost of production. Superalloys, titanium alloys and titanium aluminide alloys, zirconium alloys and nickel aluminide alloys fabricated as castings by the process as described in the present invention will find applications as jet engine parts and other high technology components requiring improved performance capabilities.

According to the present invention, during casting process the mold can be subjected to centrifuging. As a consequence of the centrifuging action, molten alloy poured into the mold will be forced from a central axis of the equipment into individual mold cavities that are placed on the circumference. This provides a means of increasing the filling pressure within each mold and allows for reproduction of intricate details.

Another teaching of the present invention involves a method of producing tubular products of superalloys and other metallic alloys as mentioned in the previous paragraphs of this application. This process is based on vacuum centrifugal casting of the selected alloys in molten state in an isotropic graphite mold coated with pyrolytic graphite, wherein the mold is rotated about its own axis.

Centrifugal castings are produced by pouring molten metal into the graphite mold which is coated with pyrolytic graphite mold and is being rotated or revolved around its own axis during the casting operation.

The axis of rotation may be horizontal or inclined at any angle up to the vertical position. Molten metal is poured into the spinning mold cavity and the metal is held against the wall of the mold by centrifugal force. The speed of rotation and metal pouring rate vary with the alloy and size and shape being cast.

The inside surface of a true centrifugal casting is always cylindrical. In semi-centrifugal casting, a central core is used to allow for shapes other than a true cylinder to be produced on the inside surface of the casting.

The uniformity and density of centrifugal castings is expected to approach that of wrought material, with the added advantage that the mechanical properties are nearly equal in all directions. Directional solidification from the outside surface contacting the mold will result in castings of exceptional quality free from casting defects.

VII. Parameters

Compressive strength is measured by ASTM C-695.

Flexural strength is measured by ASTM C 651.

Thermal conductivity is measured according to ASTM C-714.

Porosity is measured according to ASTM C-830.

Shear strength is measured according to ASTM C273, D732.

Shore hardness is measured according to ASTM D2240.

Grain size is measured according to ASTM E 112.

Coefficient of thermal expansion is measured according to E 831.

Density is measured according to ASTM C838-96.

Oxidation threshold is measured according ASTM E 1269-90.

Vickers microhardness in HV units is measured according to ASTM E 384.

VIII. EXAMPLES

Example 1

TABLE 5 lists various nickel, cobalt and iron base superalloys that are suitable candidates to be fabricated as castings with high integrity and quality under vacuum in isostatic graphite molds coated with pyrolytic graphite.

The molds for performing experiments according to the present invention are made with isostatically pressed isotropic graphite having a machined mold cavity coated with pyrolytic graphite. Some identical experiments are performed with molds made with extruded anisotropic graphite. The objective is to demonstrate the difference in the quality of castings made with different grades of graphite. The isotropic graphite and extruded graphite required for conducting the experiments can be procured, for example, from SGL Carbon Group. The pyrolytic graphite coatings can be prepared using the CVD technique by SGL Carbon.

TABLE 5

(compositions are in weight %)

| Alloy | Ni | Cr | Co | Mo | W | Fe | C | Ta + Nb | Al | Ti | Si | Others |
|---|---|---|---|---|---|---|---|---|---|---|---|---|
| IN 738 | 63 | 16 | 8.5 | 1.75 | 2.6 | 0.5 | 0.13 | 2.6 | 3.45 | 3.45 | 0.2 | 0.1 Hf |
| Rene 80 | 60.5 | 14 | 9.5 | 4.0 | 4.0 | 0.17 | | 3.0 | 5.0 | | | 0.03 Zr 0.15 B |
| Mar-M247 | 60 | 8.25 | 10 | 0.7 | 10 | | 0.15 | 3.0 | 5.5 | 1.0 | | 1.5 Hf 0.15 B 0.05 Zr |
| PWA 795 | 14.03 | 19.96 | 46.4 | | 9.33 | | 0.35 | 2.89 | 4.4 | 0.18 | 0.17 | 1.14 Hf 0.02 Zr 0.07 Y |
| Rene 142 | 57.4 | 6.89 | 11.90 | 1.47 | 5.03 | | 0.12 | 6.46 | 6.25 | 0.005 | 0.012 | 2.76 Re 1.54 Hf 0.017 Zr 0.018 B |
| Mar-M200 | 59 | 9.0 | 10.0 | | 12.5 | 1.5 | 0.15 | 1.0 | 5.0 | 2.0 | | 0.015 B 0.05 Zr |
| FSX 414 | 10 | 29 | 53.08 | | 7.0 | | 0.12 | | | | 0.8 | |
| IN 939 | 48.33 | 22.5 | 19 | | 2.0 | | 0.16 | 1.35 | 1.85 | 3.8 | | 0.005 B 0.01 Nb |
| IN 792 | 61 | 12.5 | 9.0 | 1.9 | 4.15 | 0.5 | 0.1 | 4.65 | 3.35 | 3.95 | 0.2 | |
| Mar-M918 | 19 | 19 | 54.56 | | | 0.5 | 0.04 | 7.0 Ta | | | | |
| Mar-M509 | 10 | 23.5 | 55 | | 7.0 | | 0.60 | 3.5 | | 0.2 | | 0.5 Zr |
| Alloy 1957 | 69.9 | 21.67 | 0.009 | | | | 0.012 | 2.63 | | 0.57 | 0.43 | 1.98 Pd |
| PMet 920 | 43.45 | 20 | 13.5 | 1.5 | 15.50 | | 0.045 | 4.2 Ta | 0.80 | | 0.40 | 0.60 Mn |
| Alloy 1896 | 60.23 | 14 | 9.5 | 1.55 | 3.8 | 0.10 | | 2.8 Ta | 3.0 | 4.9 | | 0.035 Zr 0.005 B |
| 501 SS | | 7.0 | | 0.55 | | 92.33 | 0.12 | | | | | |
| SS 316-GD | 11.65 | 16.33 | 2.2 | | 66.65 | | | | | | 0.1 | 0.4 Gd 1.7 Mn |

Typical shapes of castings which can be fabricated are as follows:

(1) 1 inch diameter×25 inches long (2) ½ inch diameter×25 inches long (3) ¼ inch diameter×25 inches long (4) ½ inch×2 inch×2 inch long (5) 10 inch diameter×1 inch thick.

For example, several of the alloys listed in TABLE 5 such as IN 738, Rene 142, PWA 795 and PMet 920 can typically be vacuum melted and cast as 1 inch diameter×25 inch long bars in isotropic graphite molds CVD coated with pyrolytic graphite to have excellent surface quality free from casting defects.

On the contrary, when molds made of extruded anisotropic graphite (i.e., HLM and HLR grades) were employed, the quality of the cast bars (1 inch diameter) of the alloys listed in TABLE 5 was found to be poor. The bar surfaces showed evidence of casting defects (surface irregularities, cavities, pits and gas holes). There was evidence of some interaction of the mold surface with the melt causing mold wear. The extruded graphite has low density and, low strength and large amount of porosity compared to the isostatic graphite. Consequently, the machined surfaces of the extruded graphite molds are less smooth and the castings made in such molds tend to exhibit inferior surface quality compared to those made in isotropic graphite molds coated with pyrolytic graphite. Furthermore, due to rapid erosion of mold surface in contact with molten metal during the casting process, the extruded mold deteriorates so much after it is used a few times, i.e., 2 or 3 times, that the quality of castings becomes unacceptable.

Also, an alloy IN939 was vacuum induction melted and cast as a 1 inch dia×25 inch long bar in an isotropic graphite mold which was additionally coated via CVD with pyrolytic graphite coating. The cast bar was found to have excellent surface quality with no casting defects.

Example 2

Titanium and Titanium Aluminide Castings

The major use of titanium castings is in the aerospace, chemical and energy industries. The aerospace applications generally require high performance cast parts, while the chemical and energy industries primarily use large castings where corrosion resistance is a major consideration in design and material choice.

Titanium alloys and titanium aluminide alloys are induction melted in a water cooled copper crucible or yttrium oxide crucible and cast in high density isotropic graphite molds coated with pyrolytic graphite molds.

The castings can be produced with high quality surface and dimensional tolerances free from casting defects and contamination. Use of the casting process according to the present invention eliminates the necessity of chemical milling to clean the contaminated surface layer on the casting as commonly present in titanium castings produced by the conventional investment casting method. Since the pyrolytic graphite molds did not react with the titanium melt and show no sign of erosion and damage, the molds can be used repeatedly numerous times to lower the cost of production.

TABLES 6 and 7 list several titanium and titanium aluminide alloys which can be processed into castings of high quality in isostatic graphite molds coated with pyrolytic graphite in accordance with the present invention.

TABLE 6

(Titanium alloys)

| Alloy | Composition (wt %) | | | | | | | | | |
|---|---|---|---|---|---|---|---|---|---|---|
| No. | Ti | Al | V | Sn | Fe | Cu | C | Zr | Mo | Other |
| 1 | Bal | 6.0 | 5.05 | 2.15 | 0.60 | 0.55 | 0.03 | | | |
| 2 | Bal | 3.0 | 10.3 | 2.1 | | | 0.05 | | | |
| 3 | Bal | 5.5 | | 2.1 | | | | 3.7 | 0.3 | |
| 4 | Bal | 6.2 | | 2.0 | | | | 4.0 | 6.0 | |
| 5 | Bal | 6.2 | | 2.0 | | | | 2.0 | 2.0 | 2.0 Cr 0.25 Si |
| 6 | Bal | 5.0 | | 2.25 | | | | | | |
| 7 | Bal | 2.5 | 13 | 7.0 | | | | 2.0 | | |
| 8 | Bal | 3.0 | 10 | | 2 | | | | | |
| 9 | Bal | 3 | 15 | 3 | | | | | | 3.0 Cr |
| 10 | Bal | | | 4.5 | | | | 6 | 11.5 | |

TABLE 7

(Titanium aluminum alloys)

| Alloy | Composition (wt %) | | | | |
|---|---|---|---|---|---|
| No. | Ti | Al | Nb | V | Other |
| 1 | Bal | 14 | 21 | | |
| 2 | Bal | 18 | 3 | 2.7 | |
| 3 | Bal | 31 | 7 | 1.8 | 2.0 Mo |
| 4 | Bal | 24 | 15 | | |
| 5 | Bal | 26 | 12 | | |
| 6 | Bal | 25 | 10 | 3.0 | 1.5 Mo |

Example 3

Mold Metal Interaction in Titanium Casting Made in Isotropic Graphite Mold

A titanium alloy having the composition of Ti-6Al-4V (wt %) was induction melted in a water cooled copper crucible and cast as a step plate into isotropic graphite mold. The plate was 7 inch wide×20 inch long having various thickness ranging from 2 inch to 0.125 inch.

Samples having the size 5 mm×5 mm×5 mm were cut out from the edge of the Ti-4Al-4V casting wherein one surface of the said sample is the surface in contact with the graphite mold. Carbon concentration in the cast plate was analyzed from the outer surface to 30 microns depth inside using Secondary Ion Mass Spectrometry (SIMS) technique according to ASTM 1523 and ASTM 1617.

SIMS analysis is accomplished by bombarding the sample surface with an energetic ion beam and analyzing the ions (secondary) that are sputtered from the surface. SIMS analysis can be accomplished using a high ion beam surface density (dynamic SIMS) where the material is eroded at a fast rate; or using a low ion beam surface density (static SIMS) where sputtered secondary ions carry molecular structural information, i.e. molecular ion formation is favored. Dynamic SIMS analysis is used principally as a depth profile technique where elemental information about a surface is desired. With a dynamic range of about six orders of magnitude, trace analysis is easily accomplished. The sputtered ions are measured as signals in mass spectrometer and then converted into atom concentration in comparison to similar data from standards of know concentrations.

Figure 2:
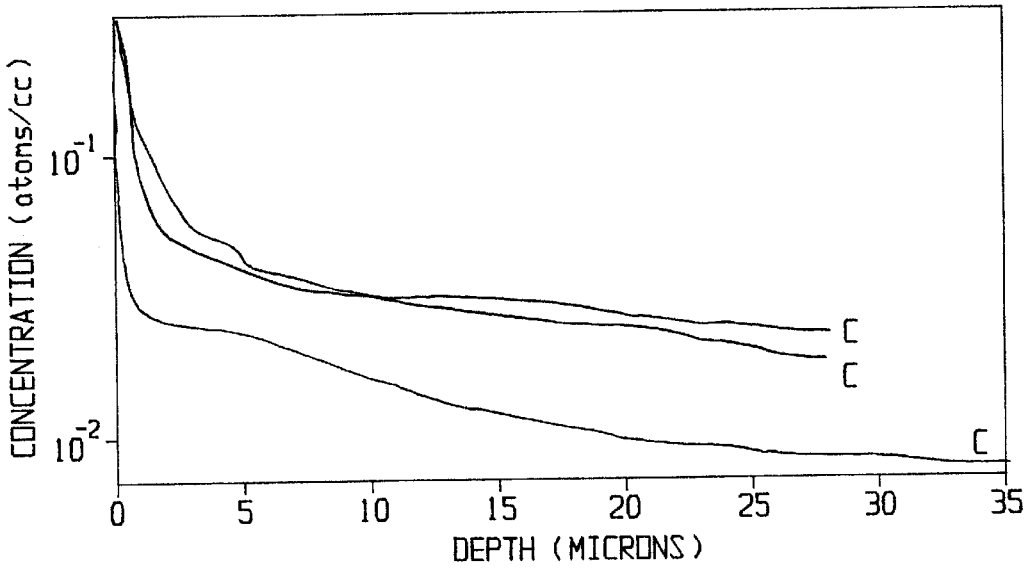
FIG. 2 shows a plot of concentration vs. depth for a SIMS analysis of carbon concentration profile as a function of depth of a sample cast as a step plate in isotropic graphite mold of Example 3.

SIMS analysis of carbon concentration profile as a function of depth is shown in FIG. 2. Three different profiles were taken from one sample at three different locations. Data from top 3 microns of the specimens are not valid due to the combination of the dynamic SIMS surface transient and the input from surface contamination. The carbon concentration profile as a function of depth in the sample taken from the bar cast in isotropic graphite mold showed gradual increase as the depth decreases towards the surface indicating carbon pick up from the isotropic graphite mold by the molten titanium alloy.

Example 4

Mold Metal Interaction in Titanium Casting Made in Isotropic Graphite Mold that was Coated via CVD with Pyrolytic Graphite A titanium alloy having the composition of Ti-6Al-4V (wt. %) was induction melted in a water cooled copper crucible and cast as a step plate into isotropic graphite mold which was further coated via CVD with pyrolytic graphite coating. The plate was 7 inch wide×20 inch long having various thickness ranging from 2 inch to 0.125 inch. Carbon concentration in the cast plate was analyzed from the outer surface to 30 microns depth inside using Secondary Ion Mass Spectrometry (SIMS) technique.

Figure 3:
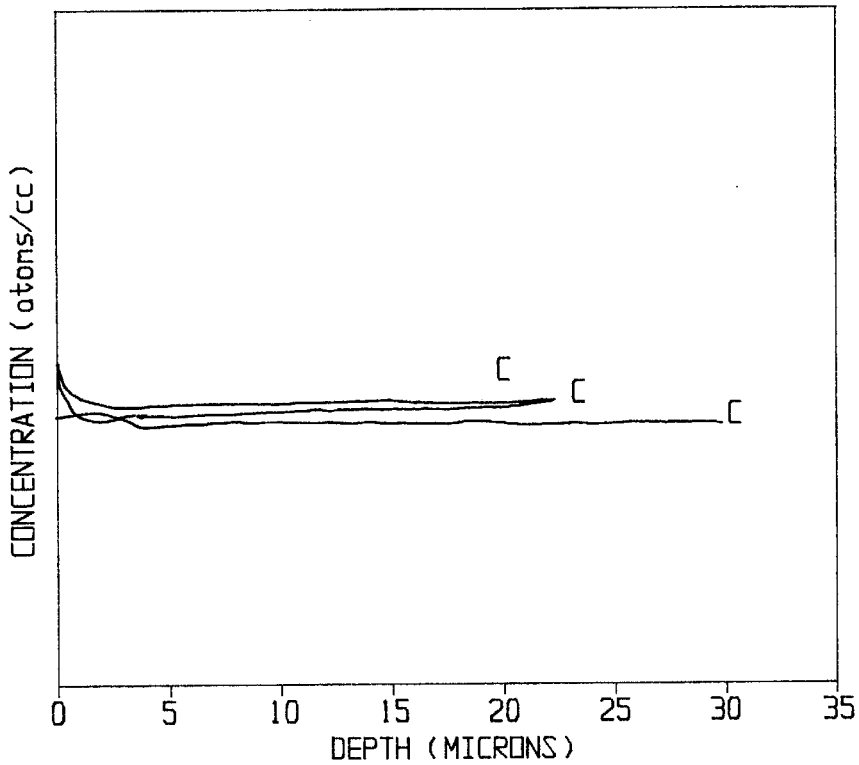
FIG. 3 shows a plot of concentration vs. depth for a SIMS analysis of carbon concentration profile as a function of depth of a sample cast as a step plate in isotropic graphite mold coated via CVD with pyrolytic graphite of Example 4.

SIMS analysis of carbon concentration profile as a function of depth is shown in FIG. 3. Data from the top 3 microns of the specimens are not valid due to the combination of the dynamic SIMS surface transient and the input from surface contamination. From the data shown in FIG. 3, it is clearly evident that the carbon concentration from surface inwards did not change as a function of depth in the titanium plate cast in pyrolytic graphite coated mold. This demonstrated that there was no reaction between molten titanium alloy and the graphite mold coated with pyrolytic graphite.

Example 5

Micro Structures of Titanium Casting Made in Isotropic Graphite Mold

The titanium casting of Example 3 was metallographically examined for microstructures and evidence of reaction of titanium melt with isotropic graphite mold. The samples with thickness, 0.75 and 1 inch taken from the step plate casting of Ti-6Al-4V of Example 3 were metallographically polished and etched.

Figure 4B:
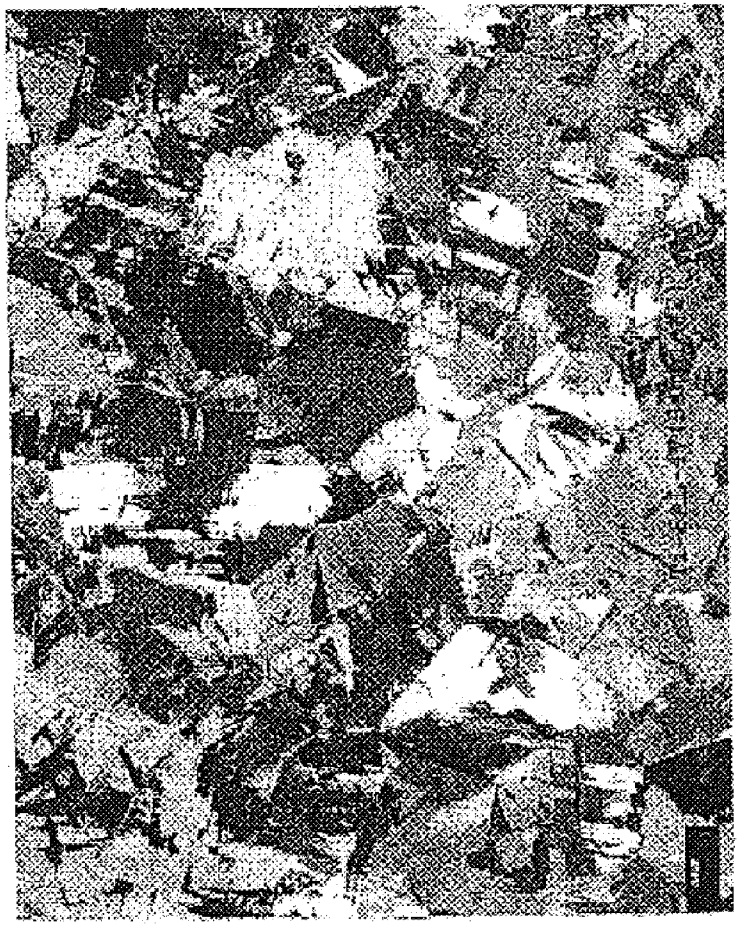
FIGS. 4A and 4B show the uniform microstructures of the bulk area of the samples of Example 5, cast as a step plate in the isotropic graphite mold of Example 3, taken from 1 inch and 0.75 inch thick castings, respectively, at a magnification of 50×.
Figure 4A:
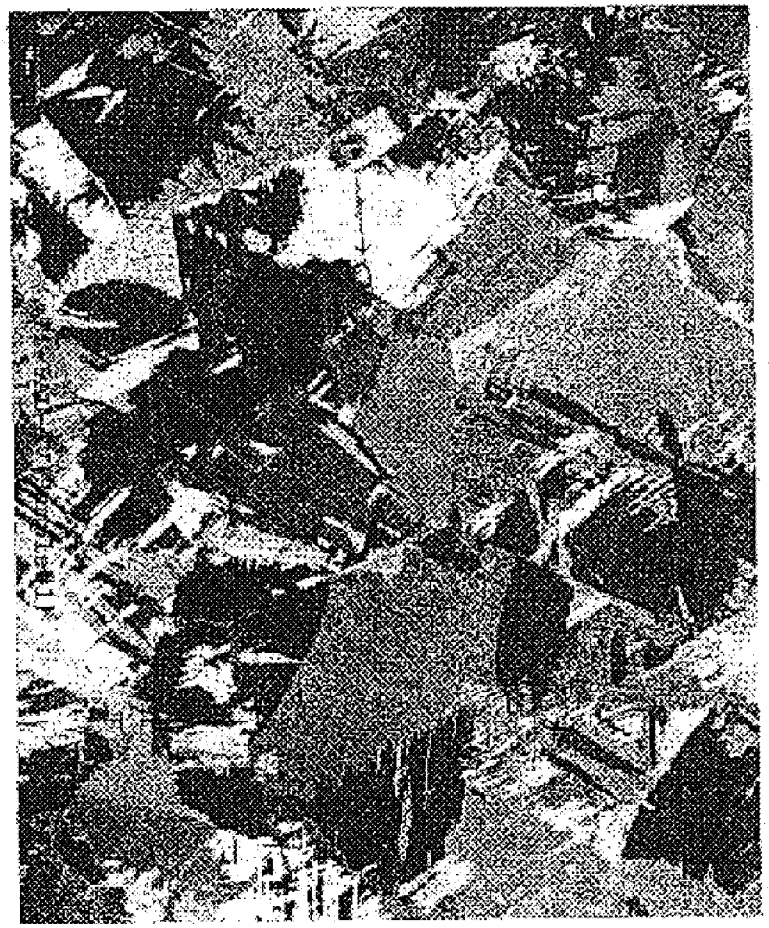

FIG. 4A shows the uniform microstructures of the bulk area of the samples having thickness of 1 inch at 50× magnification. FIG. 4B shows the uniform microstructures of the bulk area of the samples having thickness of 0.75 inch at 50× magnification.

Figure 5B:
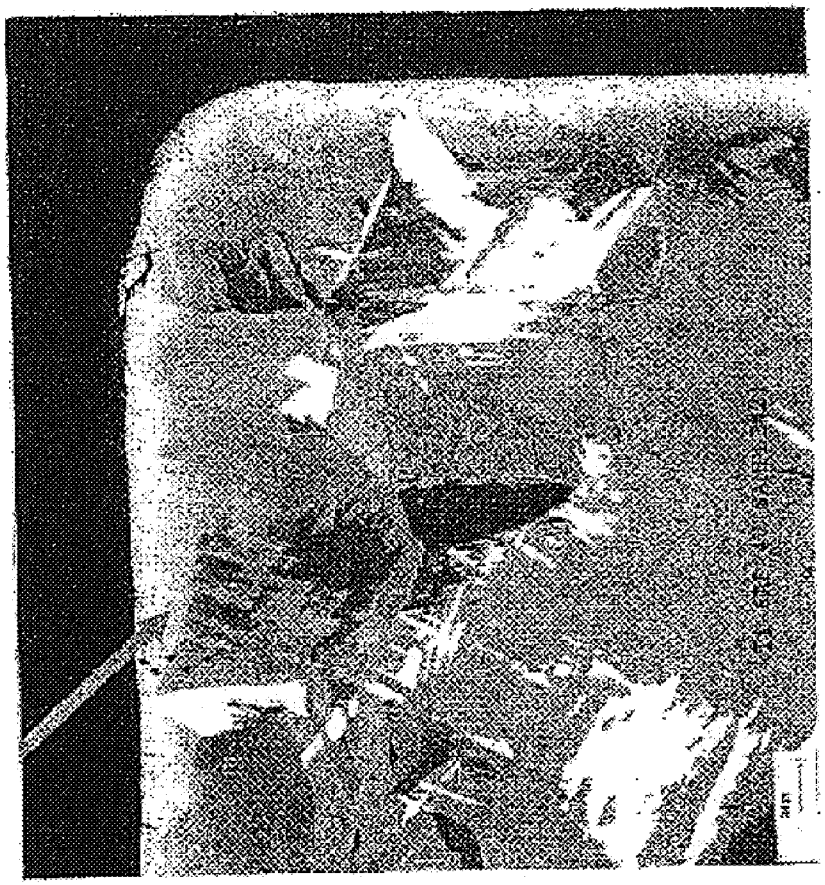
FIGS. 5A and 5B are the optical micrographs showing microstructures of the samples, of Example 5 taken from 1 inch and 0.75 inch thick castings, respectively, at a magnification of 100×.
Figure 5A:
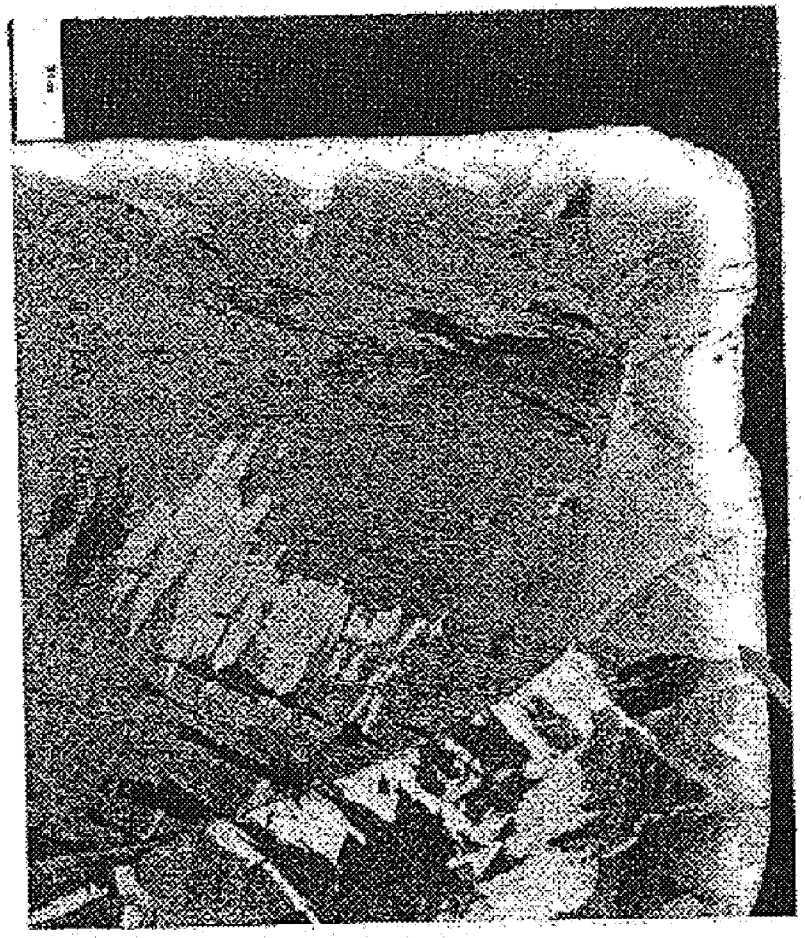

FIGS. 5A and 5B are the optical micrographs showing microstructures of the samples taken from 1 inch and 0.75 inch thick castings respectively at a magnification of 100×. The micrographs of FIGS. 5A and 5B revealed the microstructural features revealed near the graphite mold-metal interface. The photo micrographs clearly show evidence of a white alpha casing around the edge of the samples formed due to reaction of isotropic graphite mold and titanium alloy melt during solidification of the melt in the mold. The alpha casing is an oxygen enriched layer which is also detected by microhardness measurements.

Figure 6B:
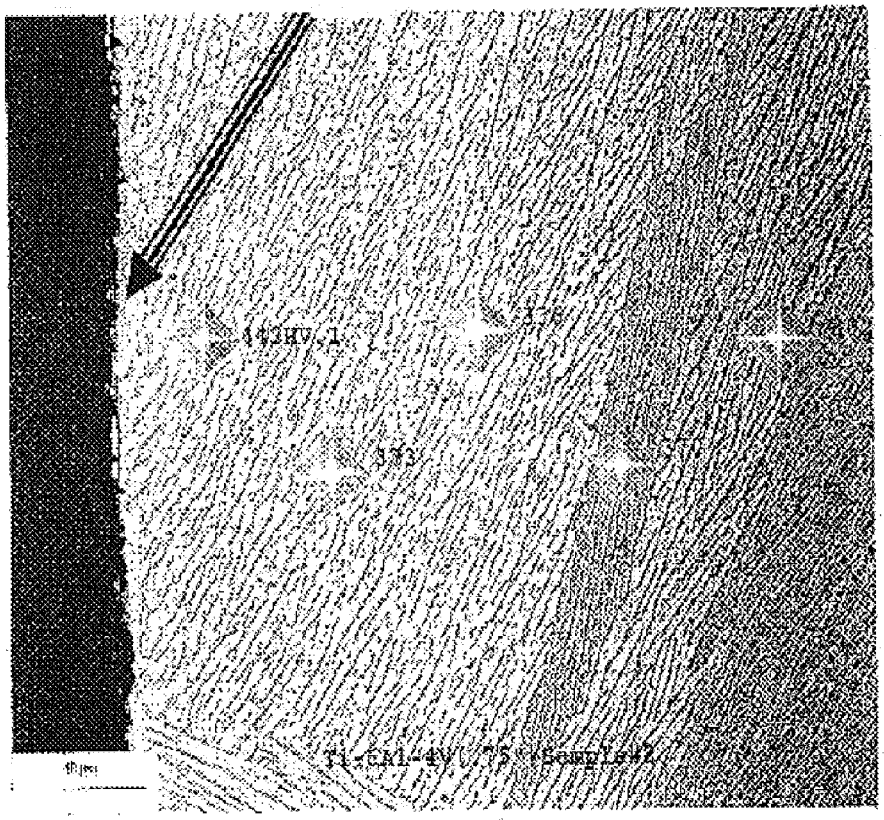
FIGS. 6A and 6B show the optical micrographs of the samples of Ti-6Al-4V casting of Example 5 taken from 1 inch and 0.75 inch thick castings, respectively, at a magnification of 1000×.
Figure 6A:
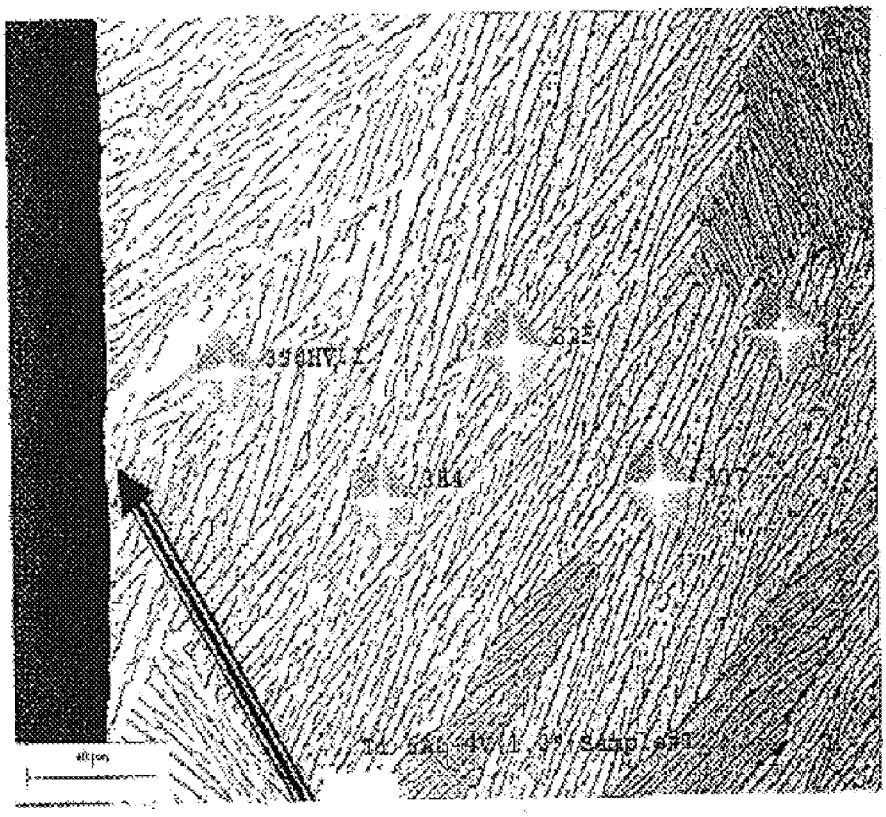

FIGS. 6A and 6B show the optical micrographs at higher magnification (1000×) of the samples of Ti-6Al-4V casting as referred in the previous paragraph.

Microhardness measurements were taken along a line perpendicular to the edge of the samples. FIGS. 6A and 6B show the microhardness indentations on the 0.75 inch thick and 1 inch thick castings respectively at 1000× magnification.

Figure 7:
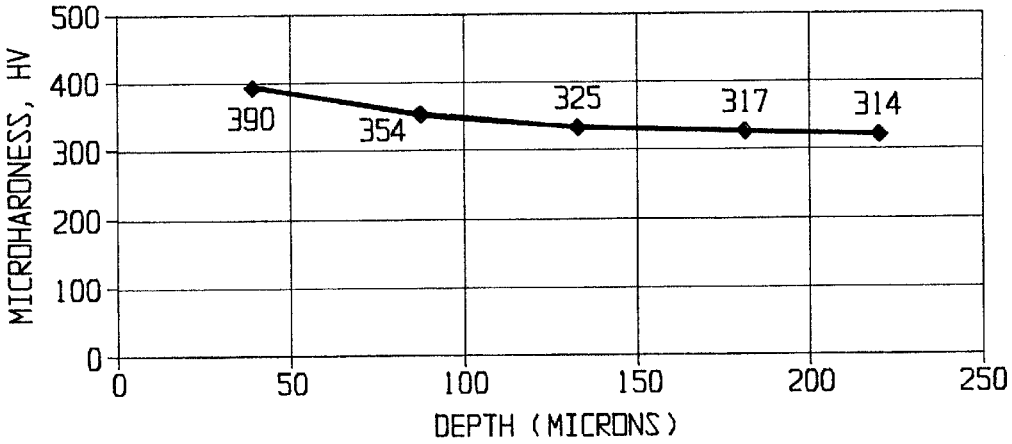
FIG. 7 shows the microhardness profile of a sample from 0.75 inch thick Ti-6Al-4V casting of Example 5 made in isotropic graphite mold.

FIG. 7 shows the microhardness profile of a sample from 0.75 inch thick Ti-6Al-4V casting made in isotropic graphite mold. Microhardness as a function of depth from the surface increased with a decrease in depth. This trend is indicative of presence of a hard alpha case layer beneath the surface of the casting. The estimated thickness of the alpha case layer formed due to reaction of titanium melt with isotropic graphite mold is approximately 150 microns.

Figure 8:
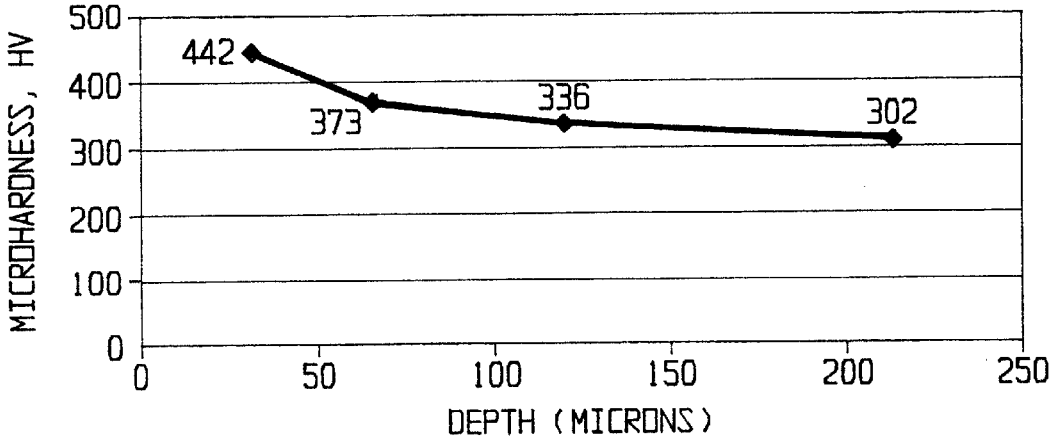
FIG. 8 shows the microhardness profile of a sample from 1 inch thick Ti-6Al-4V casting of Example 5 made in isotropic graphite mold.

FIG. 8 shows the microhardness profile of a sample from 1 inch thick Ti-6Al-4V casting made in isotropic graphite mold. Microhardness has a function of depth from the surface increase with a decrease in depth. This trend is indicative of presence of a hard alpha case layer beneath the surface of the casting. The estimated thickness of the alpha case layer formed due to reaction of titanium melt with isotropic graphite mold is approximately 250 microns. Formation of a thicker alpha case in 1 inch thick casting compared to 0.75 inch thick casting is due to slower cooling rate experienced by the thicker casting and hence more time was available for titanium to react with the graphite.

Figure 9B:
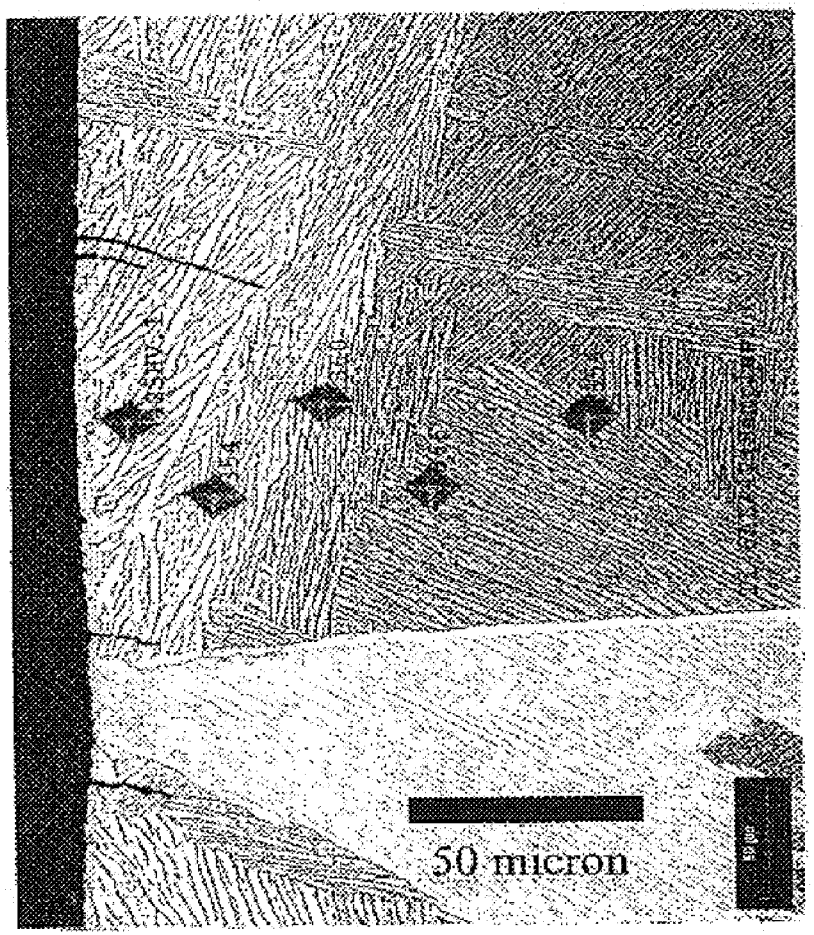
FIGS. 9A and 9B illustrate the photomicrographs at 1000× magnification of a set of samples of Example 5 (different than those of FIGS. 7 and 8), of Ti-6Al-4V step plate having thickness, 0.75 inch and 1 inch respectively, cast in isotropic graphite mold.
Figure 9A:
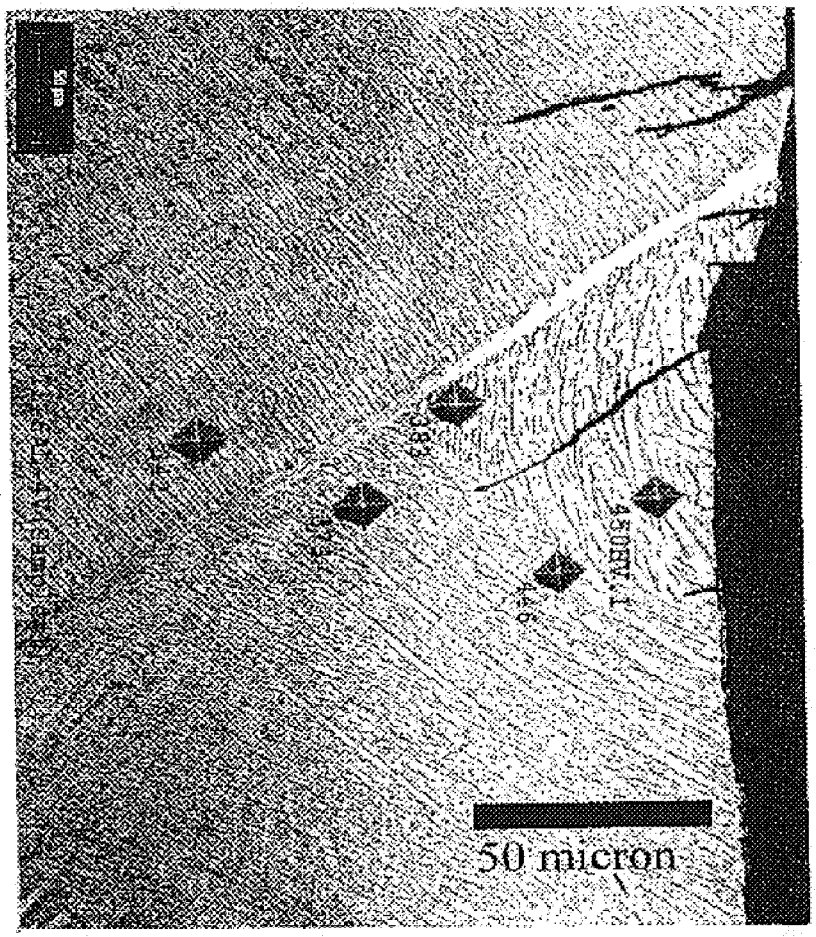

FIGS. 9A and 9B illustrate the photomicrographs at 1000× magnification of a different set of samples of Ti-6Al-4V casting having thickness, 0.75 inch and 1 inch respectively. The castings were made in isotropic graphite mold. Microhardness measurements were taken along a line perpendicular to the edge of the samples and the microhardness indentations are shown in the same micrographs. Micro cracks which were initiated from the edges of the casting samples due to the presence of hard and brittle alpha case layer are evident in the micrographs.

Figure 10:
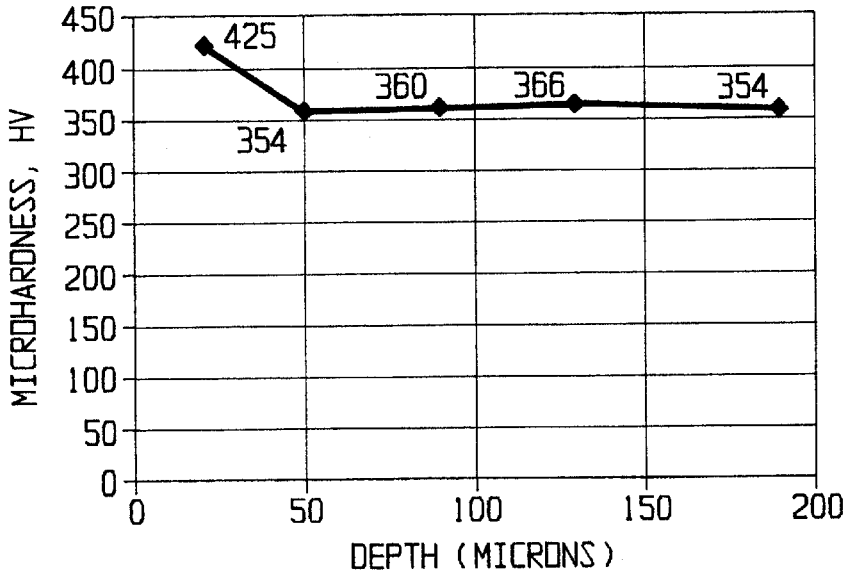
FIGS. 10 and 11 show the microhardness profiles of the Ti-6Al-4V step plate casting samples of FIGS. 9A and 9B having thickness, 0.75 inch and 1 inch, respectively.
Figure 11:
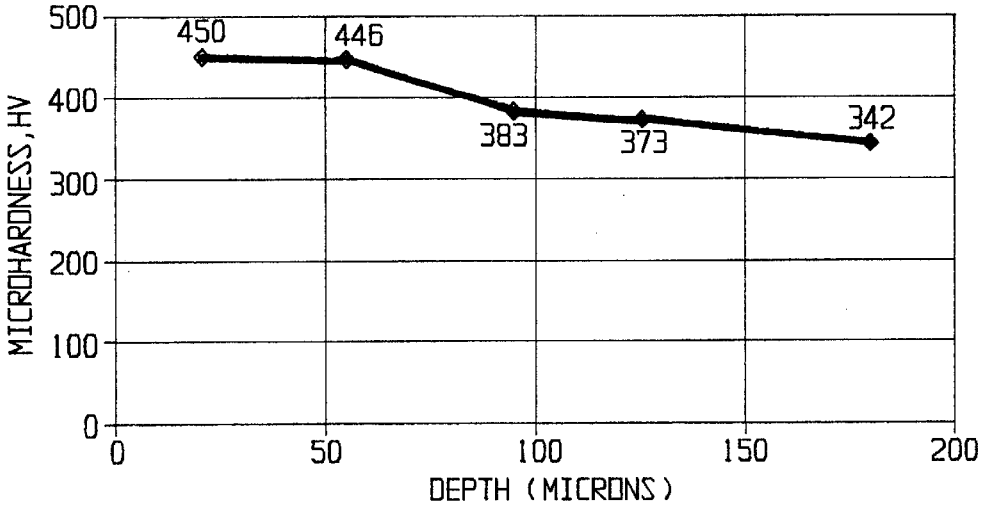

FIGS. 10 and 11 show the microhardness profiles of the Ti-6Al-4V casting samples as referred in the previous paragraph having thickness, 0.75 inch and 1 inch, respectively. Microhardness values plotted as a function of depth from the surface were found to increase with a decrease in depth. This trend is indicative of presence of a hard alpha case layer beneath the surface of the casting. The estimated thickness of the alpha case layer formed due to reaction of titanium melt with isotropic graphite mold ranges between 50 to 150 microns. Formation of a thicker alpha case (~150 micron) in 1 inch thick casting compared to that (~50 micron) of 0.75 inch thick casting is due to slower cooling rate experienced by the thicker casting and hence more time was available for titanium to react with the graphite.

Example 5

Micro Structures of Titanium Casting Made in Isotropic Graphite Mold that was Coated via CVD with Pyrolytic Graphite The titanium casting of Example 4 was metallographically examined for microstructures and evidence of reaction of titanium melt with pyrolytic graphite coated mold.

The samples with thickness, 0.5, 0.75, 1 and 1.5 inch taken from the step plate casting of Ti-6Al-4V of Example 4 were metallographically polished and etched.

FIG. 12 exhibits the uniform microstructure of the bulk area of the sample taken from 0.5 inch thick casting. FIGS. 13A and 13B exhibit the microstructures of the same sample 125× and 650×, respectively. The microstructure of the bulk area of the sample was found to be similar to that near the edge of the sample i.e. near the graphite mold-metal interface. No evidence was found in the above microstructures of a white alpha case layer around the edge of the sample similar to the one observed in the microstructure of the samples from Ti-6Al-4V casting made in isotropic graphite mold.

FIG. 14 shows the microhardness profile of the above referenced sample as a function of depth from the surface towards inside area. The microhardness values remain unchanged throughout as a function of depth which is indicative of uniformity in microstructures devoid of an oxygen enriched reaction layer of alpha casing.

The microstructures of a sample taken from a 0.75 inch thick casting of Ti-6Al-4V made in pyrolytic graphite mold are illustrated in FIGS. 15A and 15B at magnifications, 125× and 650× respectively. The microstructure of the bulk area of the sample was found to be similar to that near the edge of the sample, i.e., near the graphite mold-metal interface. No evidence was found in the above microstructures of a white alpha case layer around the edge of the sample similar to the one observed in the microstructure of the samples from Ti-6Al-4V casting made in isotropic graphite mold.

FIG. 16 shows the microhardness profile of the above referenced sample as a function of depth from the surface towards inside area. The microhardness values remain unchanged throughout as a function of depth which is indicative of uniformity in microstructures devoid of an oxygen enriched reaction layer of alpha casing.

The microstructures of a sample taken from 1 inch thick casting of Ti-6Al-4V made in pyrolytic graphite mold are illustrated in FIGS. 17A and 17B at magnifications, 125× and 650× respectively. The microstructure of the bulk area of the sample was found to be similar to that near the edge of the sample i.e. near the graphite mold-metal interface. No evidence was found in the above microstructures of a white alpha case layer around the edge of the sample similar to the one observed in the microstructure of the samples from Ti-6Al-4V casting made in isotropic graphite mold.

FIG. 18 shows the microhardness profile of the above referenced sample as a function of depth from the surface towards inside area. The microhardness values remain unchanged throughout as a function of depth which is indicative of uniformity in microstructures devoid of an oxygen enriched reaction layer of alpha casing.

The microstructures of a sample taken from 1.5 inch thick casting of Ti-6Al-4V made in pyrolytic graphite mold are illustrated in FIGS. 19A and 19B at magnifications, 125× and 650× respectively. The microstructure of the bulk area of the sample was found to be similar to that near the edge of the sample i.e. near the graphite mold-metal interface. No evidence was found in the above microstructures of a white alpha case layer around the edge of the sample similar to the one observed in the microstructure of the samples from Ti-6Al-4V casting made in isotropic graphite mold.

FIG. 20 shows the microhardness profile of the above referenced sample as a function of depth from the surface towards inside area. The microhardness values remain unchanged throughout as a function of depth which is indicative of uniformity in microstructures devoid of an oxygen enriched reaction layer of alpha casing.

It should be apparent that in addition to the above-described embodiments, other embodiments other embodiments are also encompassed by the spirit and scope of the present invention. Thus, the present invention is not limited by the above-provided description, but rather is defined by the claims appended hereto.

What is claimed is:

1. A method of making cast shapes of a metallic alloy, comprising the steps of:

melting the alloy to form a melt under vacuum or partial pressure of inert gas:

pouring the melt of the alloy into a cavity of a composite mold comprising a substrate of isotropic graphite having a mold cavity, wherein the surface of the mold cavity is coated with a pyrolytic graphite coating and solidifying the melted alloy into a solid body taking the shape of the mold cavity.

2. The method of claim 1, wherein the "c" direction of the pyrolytic graphite coating is perpendicular to the wall of the mold cavity and the pyrolytic graphite coating has a thickness between 0.1 to 5 mm and the following physical properties:

density of at least about 2.1 gm/cc, porosity of at most about 1%, compressive strength in the "c" direction of at least about 65,000 psi, and flexural strength in the "c" direction of at least about 20,000 psi.

3. The method of claim 1, wherein the cavity is a machined cavity and the pyrolytic graphite coating is deposited on the surface of the machined cavity via chemical vapor deposition and the pyrolytic graphite coating has a thickness between 0.1 to 5 mm.

4. The method of claim 1, wherein the thickness of the pyrolytic graphite coating on the surface of the cavity of the mold is from 0.5 to 5 mm.

5. The method of claim 1, wherein the thickness of the pyrolytic graphite coating on the surface of the cavity of the mold is from 1 to 3 mm.

6. The method of claim 1, wherein the isotropic graphite of the main body has been isostatically or vibrationally molded and has ultra fine isotropic grains between 3–40 micron, a density between about 1.65–1.9 grams/cc, flexural strength between about 5,500 and 20,000 psi, compressive strength between about 12,000 and 35,000 psi, and porosity below about 15%.

7. The method of claim 1, wherein the mold is at a temperature between 100 and 800° C. just prior to pouring the melt into the mold.

8. The method of claim 1, wherein the mold is at a temperature between 150 and 800° C. just prior to pouring the melt into the mold.

9. The method of claim 1, wherein the mold is at a temperature between 200 and 800° C. just prior to pouring the melt into the mold.

10. The method of claim 1, wherein the mold is at a temperature between 150 and 450° C. just prior to pouring the melt into the mold.

11. The method of claim 1, wherein the mold is at a temperature between 250 and 450° C. just prior to pouring the melt into the mold.

12. The method of claim 1, wherein the metallic alloy is selected from the group consisting of a nickel base superalloy, nickel-iron base superalloy and cobalt base superalloy.

13. The method of claim 1, wherein the metallic alloy is a nickel base superalloy containing 10–20% Cr, at most about 8% total of at least one element selected from the group consisting of Al and Ti, 0.1–12% total of at least one element selected from the group consisting of B, C and Zr, 0.1–12% total of at least one alloying element selected from the group consisting of Mo, Nb, W, Ta, Co, Re, Hf, and Fe, and inevitable impurity elements, wherein the impurity elements are less than 0.05% each and less than 0.15% total.

14. The method of claim 1, wherein the metallic alloy is a cobalt base superalloy containing 10–30% Cr, 5–25% Ni and 2–15% W and 0.1–12% total of at least one other element selected from the group consisting of Al, Ti, Nb, Mo, Fe, C, Hf, Ta, and Zr, and inevitable impurity elements, wherein the impurity elements are less than 0.05% each and less than 0.15% total.

15. The method of claim 1, wherein the metallic alloy is a nickel-iron base superalloy containing 25–45% Ni, 37–64% Fe, 10–15% Cr, 0.5–3% total of at least one element selected from the group consisting of Al and Ti, 0.1–12% total of at least one element selected from the group consisting of B, C, Mo, Nb, and W, and inevitable impurity elements, wherein the impurity elements are less than 0.05% each and less than 0.15% total.

16. The method of claim 1, wherein the metallic alloy is a stainless steel alloy based on Fe, containing 10–30% Cr and 5–25% Ni, and 0.1–12% total of at least one element selected from the group consisting of Mo, Ta, W, Ti, Al, Hf, Zr, Re, C, B and V, and inevitable impurity elements, wherein the impurity elements are less than 0.05% each and less than 0.15% total.

17. The method of claim 1, wherein the metallic alloy is based on titanium and contains at least about 50% Ti and at least one other element selected from the group consisting of Al, V, Cr, Mo, Sn, Si, Zr, Cu, C, B, Fe and Mo, and inevitable impurity elements, wherein the impurity elements are less than 0.05% each and less than 0.15% total.

18. The method of claim 1, wherein the metallic alloy is titanium aluminide based on titanium and aluminum and containing 50–85% titanium, 15–36% Al, and at least one other element selected from the group consisting of Cr, Nb, V, Mo, Si and Zr, and inevitable impurity elements, wherein the impurity elements are less than 0.05% each and less than 0.15% total.

19. The method of claim 1, wherein the metallic alloy containing at least 50% zirconium and at least one other element selected from the group consisting of Al, V, Mo, Sn, Si, Ti, Hf, Cu, C, Fe and Mo and inevitable impurity elements, wherein the impurity elements are less than 0.05% each and less than 0.15% total.

20. The method of claim 1, wherein the metallic alloy is nickel aluminide containing at least 50% nickel, 20–40% Al and optionally at least one other element selected from the group consisting of V, Si, Zr, Cu, C, Fe and Mo and inevitable impurity elements, wherein the impurity elements are less than 0.05% each and less than 0.15% total.

21. The method of claim 1, wherein the metallic alloy is a castable aluminum metal matrix composite based on an aluminum alloy which is reinforced with 20 to 60 volume percent of whiskers or particulates of at least one compound selected from the group consisting of silicon carbide, aluminum oxide, titanium carbide and titanium boride.

22. The method of claim 1, wherein the alloy is melted by a method selected from the group consisting of vacuum induction melting and plasma arc remelting.

23. The method of claim 1, wherein the mold is cylindrical and rotated at high speeds between 50 to 3000 RPM around its own axis during the casting process.

24. The method of claim 1, wherein the substrate of the composite mold has been isostatically or vibrationally molded.

25. The method of claim 1, wherein the graphite of the substrate of the mold has isotropic grains with grain size between 3 and 10 microns, flexural strength between about 7,000 and 20,000 psi, compressive strength between about 12,000 and 35,000 psi, and porosity below about 13%.

26. The method of claim 1, wherein the isotropic graphite which constitutes the substrate of the mold has a density between about 1.77 and 1.9 grams/cc and compressive strength between about 17,000 psi and 35,000.

27. The method of claim 1, wherein the substrate of the mold has been made by machining from isotropic graphite which has been isostatically or vibrationally molded.

28. The method of claim 1, wherein the pyrolytic graphite coating has a density between about 2.15 and 2.25 grams/cc and compressive strength between about 65,000 psi and 70,000 psi.

29. A mold for making cast shapes of a metallic alloy, comprising a substrate consisting essentially of an isotropic graphite, wherein the substrate has a cavity, wherein the surface of the cavity has been coated with a pyrolytic graphite coating.

30. The mold of claim 29, wherein a "c" direction of the pyrolytic graphite coating is perpendicular to the wall of the mold cavity, the pyrolytic graphite coating having a thickness between about 0.1 to 5 mm and the following physical properties:

density of at least about 2.1 gm/cc, porosity of at most about 1%, compressive strength in the "c" direction of at least about 65,000 psi, and flexural strength in the "c" direction of at least about 20,000 psi.

31. The mold of claim 29, wherein the cavity is a machined cavity and the pyrolytic graphite coating is deposited on the surface of the machined cavity via chemical vapor deposition and the pyrolytic graphite coating has a thickness between 0.1 to 5 mm.

32. The mold of claim 29, wherein the thickness of the pyrolytic graphite coating on the surface of the cavity of the mold is from 0.5 to 5 mm.

33. The mold of claim 29, wherein the thickness of the pyrolytic graphite coating on the surface of the cavity of the mold is from 1 to 3 mm.

34. The mold of claim 29, wherein the isotropic graphite of the main body has been isostatically or vibrationally molded and has ultra fine isotropic grains between about 3 and 40 microns, a density between about 1.65 and 1.9 grams/cc, flexural strength between about 5,500 and 20,000 psi, compressive strength between about 12,000 and 35,000 psi, and porosity below about 15%.

35. The mold of claim 29, wherein the substrate of the composite mold has been isostatically or vibrationally molded.

36. The mold of claim 29, wherein the graphite of the substrate of the mold has isotropic grains with grain size between about 3 and 10 microns, flexural strength between about 7,000 and 20,000 psi, compressive strength between about 12,000 and 35,000 psi, and porosity below about 13%.

37. The mold of claim 29, wherein the isotropic graphite which constitutes the substrate of the mold has a density between about 1.77 and 1.9 grams/cc and compressive strength between about 17,000 psi and 35,000.

38. The mold of claim 29, wherein the substrate of the mold has been made by machining from isotropic graphite which has been isostatically or vibrationally molded.

39. The mold of claim 29, wherein the pyrolytic graphite coating has a density between about 2.15 and 2.25 grams/cc and compressive strength between about 65,000 psi and 70,000 psi.

* * * * *